US005936649A

United States Patent [19]

Ikeda et al.

[11] Patent Number: 5,936,649

[45] **Date of Patent: *Aug. 10, 1999**

[54] RECORDING METHOD, RECORDING APPARATUS FOR CONDUCTING THE RECORDING METHOD AND INK JET CARTRIDGE FOR USE IN THE RECORDING APPARATUS

[75] Inventors: Masami Ikeda; Nobuyuki Kuwabara, both of Tokyo; Seiichiro Karita, Yokohama; Masahiro Haruta, Tokyo; Osamu Nishiwaki, Atsugi; Shinichi Tochihara, Hadano; Akira Nagashima, Tokyo; Makoto Aoki, Yokohama; Kumiko Mafune, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/427,275

[22] Filed: Apr. 24, 1995

Related U.S. Application Data

[63] Continuation of application No. 07/727,090, Jul. 9, 1991, abandoned.

[30] Foreign Application Priority Data

| | | | |
|---|---|---|---|
| Jul. 10, 1990 | [JP] | Japan | 2-180432 |
| Jul. 10, 1990 | [JP] | Japan | 2-180433 |
| Jul. 10, 1990 | [JP] | Japan | 2-180434 |
| Jul. 10, 1990 | [JP] | Japan | 2-180437 |
| May 31, 1991 | [JP] | Japan | 3-155920 |
| Jun. 29, 1991 | [JP] | Japan | 3-159226 |

[51] Int. Cl.[6] ..... B41J 2/175

[52] U.S. Cl. ..... 347/87

[58] Field of Search ..... 347/31, 86, 87, 347/92, 93, 100, 28; 73/53.01; 210/106; 521/128, 170, 171, 172, 173

[56] References Cited

U.S. PATENT DOCUMENTS

| | | | |
|---|---|---|---|
| 4,098,729 | 7/1978 | Kollmeier et al. | 521/128 |
| 4,677,445 | 6/1987 | Haruta . | |
| 4,771,295 | 9/1988 | Baker et al. | 346/1.1 |
| 4,802,989 | 2/1989 | Haruta et al. . | |
| 4,824,487 | 4/1989 | Heffernan | 134/10 |
| 4,885,932 | 12/1989 | Heffernan et al. | 73/53 |
| 4,990,545 | 2/1991 | Hourai et al. | 521/171 |
| 5,182,579 | 1/1993 | Haruta et al. | 347/93 X |
| 5,215,577 | 6/1993 | Eida et al. | 347/100 |

FOREIGN PATENT DOCUMENTS 2138835 10/1984 United Kingdom .

OTHER PUBLICATIONS

Official Letter dated Jun. 8, 1994 in EP Application Ref. No. 11626.

*Primary Examiner*—Huan Tran
*Assistant Examiner*—Thien Tran
*Attorney, Agent, or Firm*—Fitzpatrick, Cella, Harper & Scinto

[57] ABSTRACT

An ink absorbent member is prepared for holding an ink stored in an ink storing section in an ink jet cartridge. The ink absorbent member contains not more then 0.20% by weight, on the basis of the member, of a fraction of soluble matters in a liquid containing an organic polar solvent incapable of reacting with the ink absorbent member such as monohydric alcohols or alkyl ethers of polyhydric alcohols.

75 Claims, 15 Drawing Sheets

RECORDING METHOD, RECORDING APPARATUS FOR CONDUCTING THE RECORDING METHOD AND INK JET CARTRIDGE FOR USE IN THE RECORDING APPARATUS

This application is a continuation of application Ser. No. 07/727,090 filed Jul. 9, 1991, now abandoned.

BACKGROUND OF THE INVENTION

1. Field of the Invention

This invention relates to a recording method, a recording apparatus for conducting the recording method and an ink jet cartridge for use in the recording apparatus.

2. Related Background Art

It is known to use a reticulated or felted foam of typical polyether-type polyurethane foam (ink absorbent member) as an ink reservoir in some cartridges for ink jet recording, as disclosed in Japanese Patent Application Kokai (Laid-open) No. 64-26452. However, the foam has a possibility to contaminate the ink or to adversely effect the flowing characteristics of the ink, when used as an ink reservoir in the ink jet cartridge, owing to the remaining impurities in the foam. The above-mentioned Japanese Patent Application Kokai (Laid-open) No. 64-26452 discloses a method for determining the cleaning degree of foam, and Japanese Patent Application Kokai (Laid-open) No. 64-26453 (=corresponding to U.S. Pat. No. 4,824,887) discloses an apparatus for cleaning the foam. That is, the former prior art reference teaches control of an amount of involatile residues in a cleaned foam to less than 0.2% by weight on the basis of the foam and also control of a surface tension of an ink stored in the foam to a surface tension change rate of more than 40 dynes/cm or less than 7 dynes/cm. The latter prior art reference teaches an automatic system for-removing contaminants through a recyclic, closed loop using Freon 113 as a solvent on the basis of such a concept that only rinsing of a foam with a solvent provides unsatisfactory washing. However, both of these prior art references are directed only to washing of involatile residues as a cause for clogging the discharge outlet from the foam.

Since the ink absorbent member is used as encased in an ink cartridge, the ink absorbent member has been so far prepared by hot pressing an ether-type foaming polyurethane in most cases. That is, the foaming polyurethane is sliced to a desired thickness and then is converted to a continuous foam body through a known film-forming process, followed by hot pressing at a high temperature such as 190° to 210° C. and cutting to a predetermined size to obtain ink absorbent members. The rigidity of the ink absorbent member can be improved by the hot pressing thereby facilitating its insertion into an ink tank and eliminating vibration of the ink absorbent member in the ink tank to stabilize ink feeding to the discharge outlet.

When the ink absorbent member is used directly after the hot pressing, impurities contained in the ink absorbent member are dissolved into the ink to lower the printing quality. According to the conventional practice, the ink absorbent member is washed with a halocarbon-based solvent such as Flon after the hot pressing and dried, and then provided in an ink tank to subject the ink absorbent member to ink impregnation and absorption.

In order to prevent volatilization and evaporation of the ink, the ink cartridge using such an ink absorbent member is packaged in a gas-tight container one by one. Furthermore, in order to prevent an ink leakage, all the openings open to the outside are pasted with a sealing member such as a seal tape to completely cover the entire openings. Gas tightness is further ensured by providing a cap having an elastic member onto the sealing member. The elastic member includes, for example, rubber, etc.

However, the above-mentioned prior art has such disadvantages as a necessity for a special washing apparatus because the foam is washed with a highly volatile, Flon-based solvent having a harmful effect on the environment, and a high possibility for an adverse effect on recording when the even a trace amount of Flon-based solvent remains in the foam owing to poor compatibility with the ink, though the Flon-based solvent is used only for the washing purpose.

Furthermore, the washing degree is evaluated in the prior art by determining involatile impurities as weight of dry extract on the basis of weight changes of foam, and thus the exactness and reproducibility of measurements are not satisfactory owing to high hygroscopic properties of foam itself and impurities themselves, and it is quite difficult to obtain foams with a satisfactory cleaning degree. Furthermore, since the involatile impurities are defined in the prior art merely as weight of dry extract, it is not clear what the individual impurities really are, and thus it is quite difficult to conduct an efficient and effective control of essential substances as main factors. Thus, there are large fluctuations in the evaluation of the cleaning degree of foams even in the prior art and there are problems in constant supply of highly reliable products.

Moreover when an ink is caused to leak from the ink jet cartridge for some reason during the handling of ink jet cartridge, the leaked ink fouls the ink jet cartridge, because the rubber cannot absorb the ink, and sometimes flows to electrical contacts to cause a contact failure.

The present inventor thus studied use of materials capable of absorbing an ink as the elastic member. As the materials capable of absorbing the ink, foamed polyurethane containing foams in a fine continued cell structure was found preferable, and thus the present inventor studied use of ester-type foamed polyurethane prepared by polymerization of polyesterpolyol with diisocyanate according to a known process. However, the present inventor found that, when the ester-based foamed polyurethane was used as an elastic member for the ink jet cartridge cap, the foamed polyurethane deteriorated, if preserved for a long time such as one month or more, particularly at a high temperature, for example, about 60° C., and the foamed polyurethane lost elasticity and failed to press the sealing member. Furthermore, the water absorbability was lowered causing to cause an ink leakage.

SUMMARY OF THE INVENTION

An object of the present invention is to provide an ink jet cartridge free from dissolution of impurities as factors for deteriorating the recording quality from an ink absorbent member into the ink and a recording apparatus using such a cartridge as mentioned above, thereby solving the problems of the prior art.

Another object of the present invention is to provide an effective washing method free from any environmental problem, based on a novel method for exact quantitative determination of impurities in a foam with a good reproducibility as a method for continuously obtaining foams with a constant cleaning degree.

Another object of the present invention is to provide an ink jet cartridge having an ink absorbent member with much less dissolution of impurities into an ink and incapable of deteriorating the recording quality even after preservation for a long time without necessitating any washing step, and a recording apparatus using the cartridge.

A further object of the present invention is to provide an ink jet cartridge having an ink absorbent member capable of preventing deterioration of recording quality due to the dissolution of impurities and of maintaining a stable recording quality for a long time, and a recording apparatus using the cartridge.

Another object of the present invention is to provide an ink jet cartridge having a cap with an elastic member incapable of deterioration even when preserved or marketed for a long time, particularly at a high temperature and capable of absorbing a leaked ink, if any, and a recording apparatus using the cartridge.

On the process of researching the novel problem as mentioned above, various using and recording methods have been considered from every point of view, so that a primary factors have been clarified. As the result, the present invention has been completed. The main constitutions thereof can be divided broadly into the categories as follows: Ink reserving capacity proper at any use states, negative pressure generating capacity, property in ink absorbent member itself wherein use property at a long term is satisfied, and property of the change of state at the use environment of the ink absorbent member to ink at the ink-reserving state in the use state. In any constitution thereof, novel technical problems are the eluted (extracted) materials from the ink absorbent member which are eluted (extracted) into the ink.

Regarding the change of state of the ink absorbing body to the ink during use, the amount of impurity extracted from an ink-absorbent member per gram of ink, which depends on an amount of ink in the environment where the ink-absorbent member is located, is an important consideration. Regarding the ink-absorbent member itself, the amount of the impurity extracted from a whole ink-absorbent member should be considered. As the result, it has been recognized that the consideration of the extract amount of the impurity per gram of the ink-absorbent member is most appropriate. Further as to the optimum condition, it has also been turned out that advantageous effect of being exceedingly stable on even the various scattering on the manufacturing and the use state is taken by satisfying a condition suitable for both of the property of the change of state at the use circumstance of the ink-absorbent member to the ink and the property of the ink-absorbent member itself.

Accordingly, regarding the ink tank holding the ink, the ink-absorbent member located in a large quantity of ink, and so forth, the present invention is explained mainly in the extract amount of the impurity from the ink-absorbent member per g of ink. Further the ink-absorbent member for holding ink is explained in mainly the extract amount of the impurity per g of the ink-absorbent member.

To solve the above-mentioned problem, the present inventors have found that the amount of the impurity extracted from the ink-absorbent member into the ink should be 0.04% or less by weight per g of ink and the extract amount of the impurity in the whole ink-absorbent member should be 0.2% or less by weight per g of the ink-absorbent member.

The other object and outline of the present invention will be able to be understood from the following explanations. Further, although the present invention is explained in the examples, laying stress on the optimum examples, it is a matter of course that the present invention includes the whole subjects adapted to the inventive thought disclosed in the specification.

DESCRIPTION OF THE PREFERRED EMBODIMENT

The embodiment of the present invention is described below by reference to the drawings.

Figure 1:
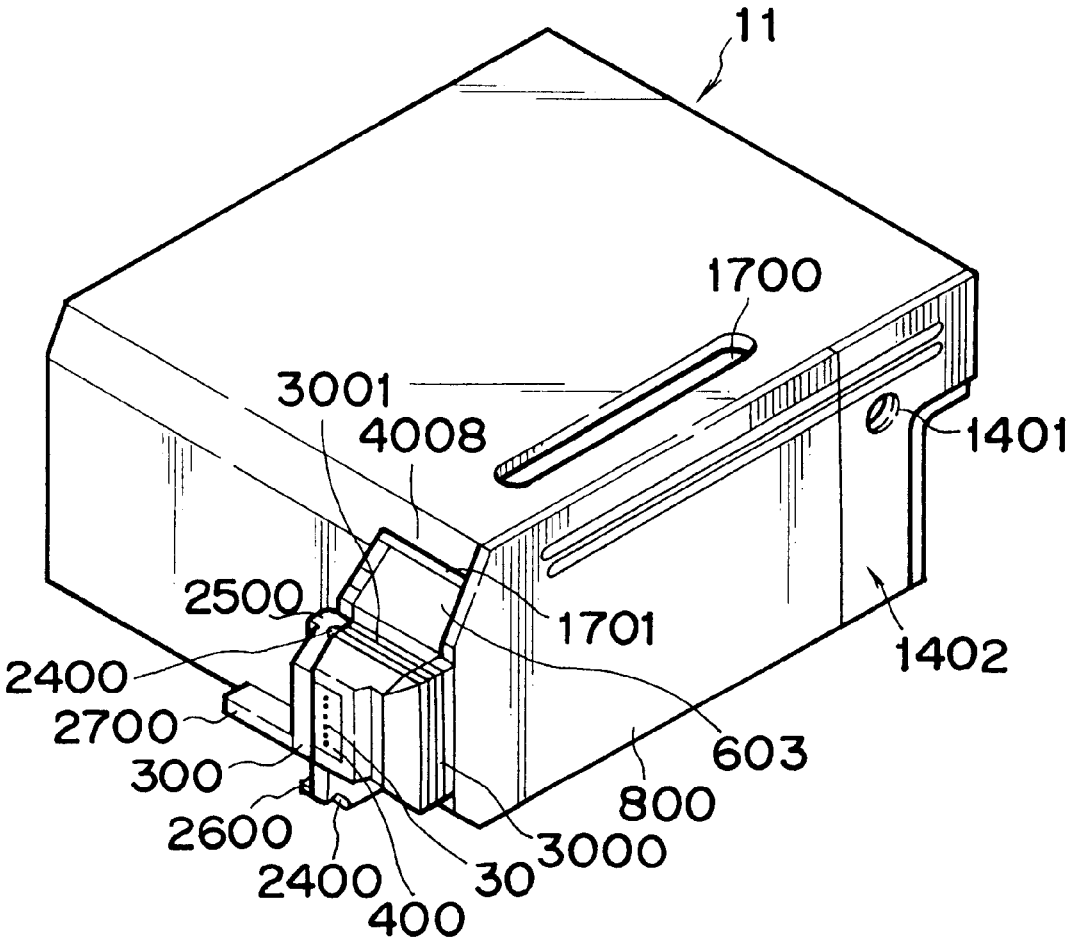
FIG. 1 is an oblique view of an ink-jet cartridge 11 employed in an ink-jet recording apparatus in an exampleo he present invention.
Figure 2:
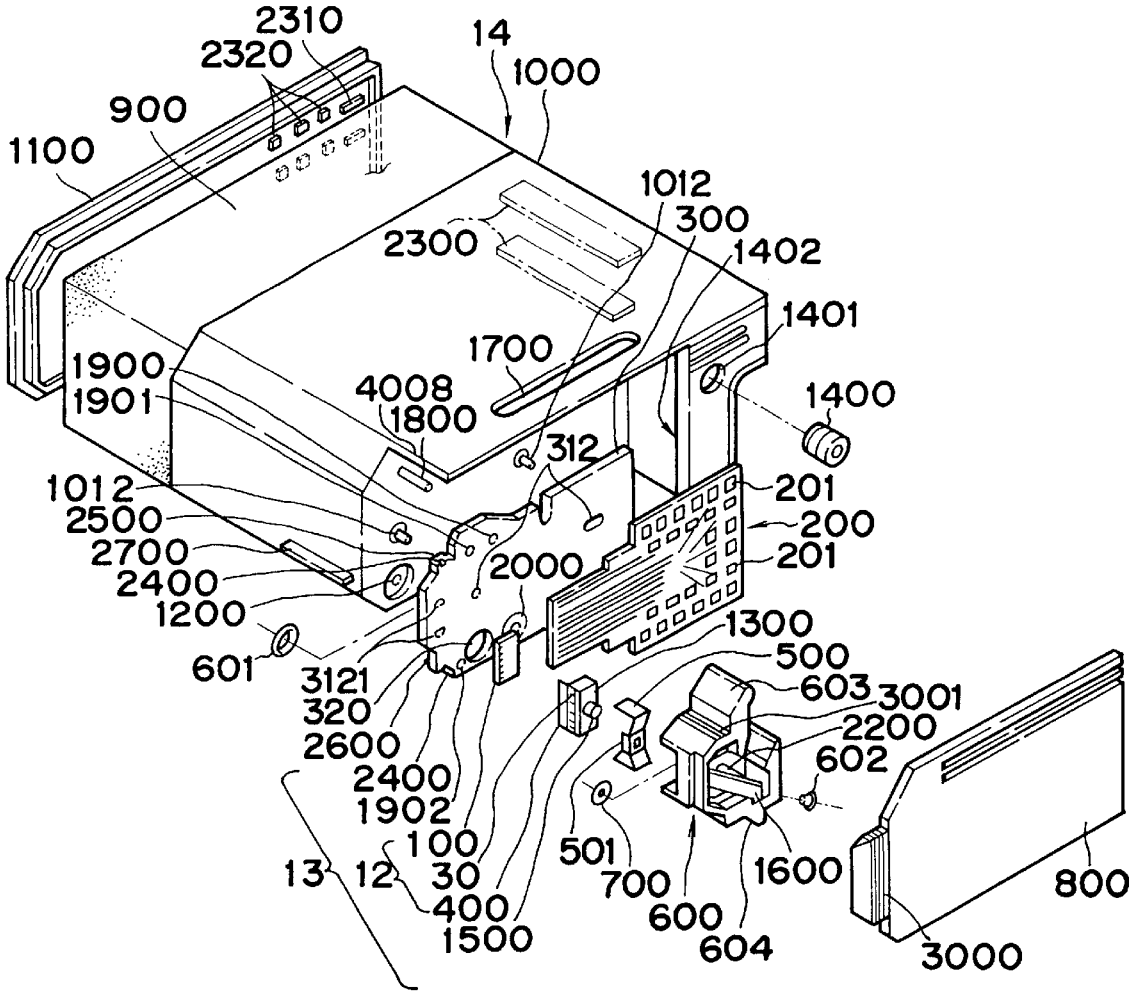
FIG. 2 is an exploded view showing the construction of e ink cartridge 11.

FIG. 1 is an oblique view of an ink-jet cartridge 11 employed in an ink-jet recording apparatus of the present invention. FIG. 2 is an exploded view showing the construction of the ink-jet cartridge 11. The following description is mainly based on FIG. 2, and other referred drawings are denoted by FIG. number in parentheses.

The ink-jet cartridge 11 is constructed from an ink-jet unit 13 including an ink-jet head 12 having a multiplicity of ejection outlets 30 formed in one body and corresponding to a recording head, electric wiring thereto, and tubes, and an ink tank 14 for holding ink in one body. The ink-jet cartridge 11 of this example has a larger ink-holding capacity than conventional ones, and has a tip portion of the ink unit 13 slightly projecting from the front face of the ink tank 14. This ink-jet cartridge 11 is fixed and supported by a registration means and electric contact points described later of carriage 16 mounted on main body 15 of the ink-jet recording apparatus , and is detachable from the carriage 16 (see FIG. 5).

Firstly, the construction of the ink-jet head 12 is explained.

Figure 3:
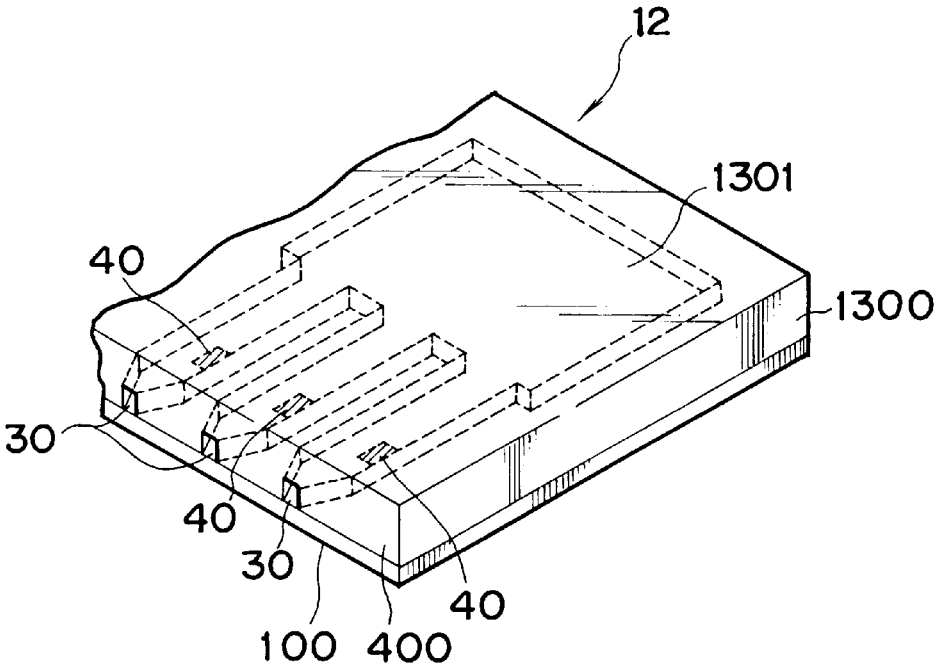
FIG. 3 is a partial oblique view of an ink-jet head 12.

As shown in FIG. 3, the ink-jet head 12 has a plurality of ejection outlets 30 placed in lines. And an electro-thermal transducer 40 is provided in each liquid line for thermal energy generation by voltage application. Application of driving signals thereto causes generation of thermal energy in the electrothermal transducers, giving rise to film boiling to form bubbles in the ink liquid path. The growth of the bubbles serve to eject the ink droplets from the ejection outlets 30. The respective electrothermal transducers 40 are provided on a heater board 100 composed of a silicon base plate, and are formed by film-forming technique integrally with aluminum wiring (not shown in the drawing) for supplying electric power to the respective electro-thermal transducer. The grooved cover plate 1300 having separator for separating the plurality of ink paths and the common liquid chamber 1301 for holding ink temporarily, etc. and the orifice plate 400 having an ink inlet 1500 for introducing ink from the ink tank 14 to the common liquid chamber 1301 and an orifice plate 400 having a plurality of ejection outlets 30 corresponding to respective ink flow paths are formed integrally. The material therefor is preferably polysulfone, but other molding resins such as polyethersulfone, polyphenylene oxide, polypropylene and the like may also be applicable.

Secondly, the construction of the ink-jet unit 13 is explained.

The one end of the wiring base board 200 is reciprocally connected to the wiring portion of the heater board 100 of the ink-jet head 12, and the other end of the wiring base board 200 is provided with a plurality of pads 201 corresponding to the respective electro-thermal transducer 40 (FIG. 3) for receiving electric signals from the main apparatus. Thereby the electric signals from the main apparatus is supplied to the respective electro-thermal transducers 40.

A metallic support 300 which supports the back side of the wiring base board 200 a plane makes the bottom plate of the ink-jet unit 13. The pressor bar spring 500, which is in a M-letter shape, presses the common liquid chamber 1301 (FIG. 3) with the center portion of the M-shape. The apron portion 501 presses concentratedly a portion of the liquid paths, preferably the region around the ejection outlets 30 with a line pressure. The heater board 100 and the cover plate 1300 are engaged between the pressor bar spring 500 and the support 300 with the foot portion of the pressor bar spring engaged with the back side of the support 300 through the holes 3121, and press-fixed with each other by the concentrated force of the pressor bar spring 500 and the apron portion 501 thereof. The support 300 has holes 312, 1900, 2000 respectively engaged with the two registering projections 1012 of the ink tank 14, and registering and heat-fusion-holding projections, 1800 and 1801, and further has registering projections 2500 and 2600 at the back side corresponding to the carriage 16. The support 300 further has a hole 320 enabling an ink-supplying tube 2200 (described later) from the ink tank 14 to pass through. Onto the support 300, a wiring base plate 200 is bonded by use of an adhesive and so forth.

Figure 5:
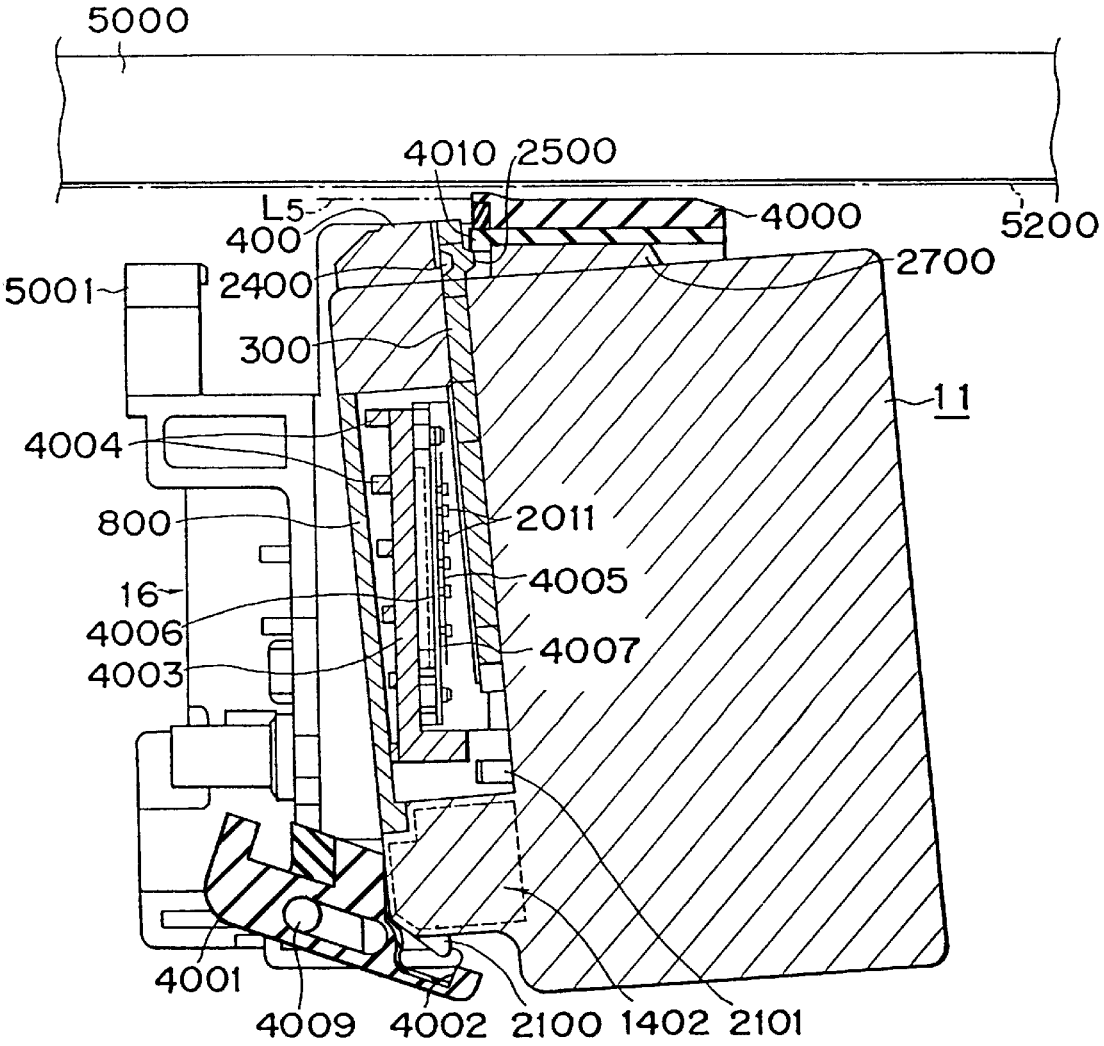
FIG. 5 is a drawing for explaining the fitting up of an ink-jet cartridge 11 to a main body of an ink-jet recordit apparatus 15.

The hollow portions 2400, 2400 of the support 300 are respectively made in the vicinity of the projections 2500, 2600, therefore, in the assembled ink-jet cartridge 11 (FIG. 1), they are at the tip region of the head which is formed by parallel grooves 3000, 3001, in surrounding three sides, thereby preventing the undesired matter such as dirt and ink from reaching the projections 2500, 2600. The cover member 800 having parallel grooves 3000 forms the external wall of the ink cartridge 11,as shown in FIG. 5, and also forms a space with the ink tank 14 for holding the ink-jet unit 13. In the ink-supplying member 600 having a parallel grooves 3001 formed thereon, the ink introducing tube 1600 connected to the ink supplying tube 2200 is fixed in a form of a cantilever at the side of ink supplying tube 2200. In order to create a capillary phenomenon between the fixed side of the ink-introducing tube 1600 and the ink supplying tube 2200, a sealing pin is inserted therein. A packing 601 is employed for connection of the ink tank 14 and the ink supplying tube 2200. A filter 700 is provided at the end portion of the ink supplying tube at the side of the ink tank 14.

Since the ink-supplying means 600 is prepared by mold-forming, it is inexpensive and is positionally precise, and the production accuracy is maintained high. Owing to the cantilever structure of the ink introducing tube 1600, the pressure-contact of the ink-introducing tube with the ink inlet 1500 is kept stable even in mass production. In this example, the communication state is ensured by flowing a sealing adhesive from the side of the ink-supplying member 600 under the pressure contact state. The ink-supplying member 600 is readily fixed to the support 300 in such a manner that two pins (not shown in the drawing) at the back side of the ink-supplying member 600 are projected through the holes 1901, 1902 on the support 300 respectively and fusion-bonded. The small projections formed by fusion bonding are accommodated by hollows (not shown in the drawing) on the lateral side of the ink tank 14 on which the ink-jet unit 13 is attached, so that the position of the ink-jet unit 13 is precise.

The construction of the ink tank 14 is described below.

The ink tank 14 is constituted of the main body of the cartridge 1000, the ink absorbing body 900, and the cover member 1100, and is formed by inserting the ink absorbing body 900 into the main body of the cartridge 1000 from the side opposite to the ink-jet unit 13, and subsequently sealing it with the cover member 1100.

The ink-absorbing body 900 is provided for holding the ink by impregnation, and is placed in the main body of the cartridge 1000. The detail is described later. The ink supply inlet 1200 is provided to supply ink to the ink-jet unit 13, and also serves in assembling the ink-jet cartridge 11 as an ink supply inlet for impregnating ink into the ink-absorbing body 900. The ink tank 14 has an air hole 1401 for communicating air to the inside, and a liquid repelling material 1400 is placed inside the air hole 1401 to prevent leakage of the ink therefrom.

In this example, for supplying ink satisfactorily from the ink-absorbing body 900, a continuous air space is formed by the ribs 2300 in the main body of the cartridge 1000 and the partial ribs 2310 and 2320 of the cover member 1100 in the region from the air hole 1401 to the corner portion most distant from the ink supply inlet 1200. Therefore, ink is supplied relatively satisfactorily from the ink supply inlet 1200 to the ink absorbing body 900, which is important. This method is extremely effective practically. The ribs 2300 four in number are provided on the back face of the main body of the cartridge 1000 of the ink tank 14 in a direction parallel to the moving direction of the carriage 16 (FIG. 6) to prevent the close contact of the ink-absorbing body 900 with the back face. The partial ribs 2310, 2320 are placed at the positions on extension lines of the ribs 2300 respectively and on the inside face of the cover member 1100, and are in a divided state different from that of the ribs 2300, so that the air space is enlarged. The partial ribs 2310, 2320 are distributed in the area not more than half of the all area of the cover member 1100. The ribs make the ink in the farthest corner portion from the ink supply outlet 1200 of the ink absorbing body 900 possible to introduce the ink by capillary force to the ink supply outlet 1200 from the farthest corner portion.

The aforementioned constitution and the arrangement of the ribs are particularly effective for the above ink tank 14, which has an ink holding space in a form of a rectangular solid having its long side on the side face, In the case where the rectangular solid has its long side along the direction of moving direction of the carriage 16 (FIG. 6), the ink supply from the ink-absorbing body can be stabilized by providing the ribs over the whole face of the cover member 1100. The rectangular solid form is suitable for holding ink as much as possible in a limited space. In order to use the stored ink effectively for recording without loss, the ribs playing the above role are preferably provided on two face regions neighboring to the corner portion. Further, the inside ribs of the ink tank 14 in this example are distributed uniformly in the thickness direction of the ink-absorbing body 900 in a rectangular solid form. This constitution enables maximum utilization of ink substantially of the entire ink in the ink-absorbing body 900 by leveling the atmospheric pressure distribution. The distribution of the ribs is based on the technical idea below. When the position of the ink supply inlet 1200 is projected onto the upper face of the rectangle of the rectangular solid and a circle is drawn around the projected position as a center with a radius of the length of the long side of the rectangle, it is important to provide the ribs at the area outside the circle line in order to early give the atmospheric pressure state. In this case, the position of the air hole of the ink tank is not limited to that in this example provided that the air is introduced to the rib-distributed region.

In this example, the back side of the ink cartridge 11 opposite to the ink-jet head 12 is made planar to minimize the necessary space when incorporated in the apparatus and maximize the quantity of the ink held therein, whereby the apparatus can be miniaturized and the frequency of cartridge exchange is decreased desirably. Behind the space for integrating the ink-jet unit 13, a projection of the air hole 1401 is formed and the inside of the projected portion is made vacant to form an atmospheric pressure supplying space 1402 for entire thickness of the ink-absorbing body 900. Such This creates a movel ink-jet cartridge having excellent performance. This atmospheric pressure supplying space 1402 is far much larger than conventional ones, and the air hole 1401 is placed at a higher position. Therefore, if the ink comes off from the ink-absorbing body 900, this atmospheric pressure supplying space 1402 is capable of retaining the ink temporarily, enabling steady recovery of the ink to the ink-absorbing body 900, thus providing an efficient and excellent cartridge.

Figure 4:
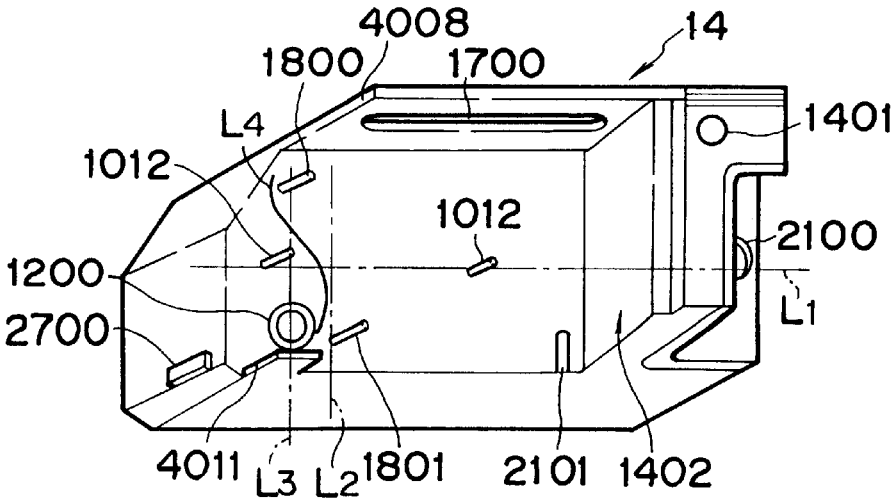
FIG. 4 is a drawing for explaining the portion of the ink tank 14for fitting up the ink-jet unit 13.

The constitution of the face of the ink tank 14 on which the ink-jet unit 13 is attached is shown in FIG. 4. Two projections 1012 for registration engaging with the holes 312 on the support 300 are on a straight line $L_1$ which passes near the center of the ejection outlet of the orifice plate 400 and is parallel to the bottom face of the ink tank 14 or a base face of the mounting of the carriage 16. The height of the projection 1012 is slightly less than the thickness of the support 300, and register the support 300. On the extension line of L in this drawing, a claw 2100 is provided which engages with an engaging face 4002 perpendicular to the hook 4001 for registering the carriage 16 as shown in FIG. 5. Thus the force for registering the carriage 16 is exerted in the a planar region parallel to the base face containing the line $L_1$. As mentioned later, such construction relation is effective since the accuracy of registration of the ink tank 14 itself is nearly equal to the accuracy of the positional registration of the outlet of the ink-jet head 12.

The projections 1800, 1801 of the ink tank 14 corresponding respectively to the holes 1900, 2000 on the support 300 for fixing it to the side face of the ink tank 14 are longer than the aforementioned projection 1012, and are utilized for fixing the support 300 by bonding by fusion of the portion projecting through the support 300. On a line $L_3$ perpendicular to the above-mentioned line $L_1$ and passing the projection 1800, approximate center of the ink supply inlet 1200 is placed. Thereby the bonding of the ink supply inlet 1200 with the ink supply tube 2200 is stabilized, and a load caused by dropping or impact exerted to the bonding is reduced. The line $L_2$ passes the projection 1801. The lines $L_2$, and $L_3$ do not coincide with each other. The projections 1800, 1801, also serve for registering the ink-jet head 12 relative to the ink tank 14. The curve $L_4$ denotes position of the outside wall when the ink supplying member 600 is mounted. The projections 1800, 1801 are along the curve $L_4$, which give sufficient strength and positional precision against the weight of the construction of tip portion of the ink-jet head 12. The tip collar 2700 of the ink-jet head 12 is inserted to the hole of the front plate 4000 (FIG. 5) of the carriage 16, to meet abnormality such as extreme displacement of the ink tank 14. The stopper 2101 against slipping from the carriage 16 is provided to fit a bar (not shown in the drawing) of the carriage 16, and is a protecting member for maintaining the mounted state when the ink-jet cartridge 11 comes under the bar at the position where cartridge 11 had been mounted and receives a vertical force to displace it from the determined position.

The ink-jet unit 13 is mounted to the ink tank 14, and then covered with the cover member 800 to enclose the ink-jet unit 13 except the bottom opening portion. The ink-jet cartridge 11, however, is mounted on the carriage 16, and the bottom opening comes close to the carriage 16, substantially forming a four-side-enclosed space. Although the enclosed space serves effectively for thermal insulation for heat generated by the ink-jet head 12, slight temperature elevation will be caused in long time of running. As the countermeasure thereto in this example, a slit 1700 is provided which has a smaller width than the enclosed space to prevent temperature elevation and simultaneously uniformize the temperature distribution throughout the the entire ink-jet unit 13 independently of the environment.

After the ink-jet cartridge 11 is assembled, the ink is supplied to the ink supplying member 600 from the interior of the main body of the cartridge 1000 through the ink supply inlet 1200, the hole 320 on the support 300, and an introducing opening at the back side of the ink supplying member 600, and then flows into the common liquid chamber through an outlet hole, a suitable supply tube, and the ink inlet 1500 on the cover plate 1300. The ink supply path is ensured by sealing the connections for jointing the ink with packings made of silicone rubber, butyl rubber or the like.

As described above, the ink supplying member 600, the cover plate 1300 with the orifice plate 400, and the main body of the cartridge 1000 are respectively molded as an integrated part, which makes the assemblage precise and is effective in high-quality mass production. The number of parts is less than conventional products, so that the intended superior characteristics are surely obtained.

In the assembled ink-jet cartridge 11 in this example, a slit 1701 is provided between the upper face 603 of the ink-supplying member 600 and the end portion 4008 of the roof portion having a long and narrow opening 1700 of the ink tank 14 as shown in FIG. 1. Similarly, a slit (not shown in the drawing) is formed between the bottom face 604 of the ink-supplying member 600 and a head-side end portion 4011 of the thin plate member adhered to the cover member 800 at the lower portion of the ink tank 14. These slits accelerate the heat release from the aforementioned opening 1700, and will prevent any direct action of force to the ink-supplying member 600 or the ink-jet unit 13 if unnecessary force is exerted to the ink tank 14.

As described above, the construction of the present invention is novel. Not only each of the construction units is effective singly, but also the combination thereof is particularly effective.

The mounting of the ink-jet cartridge 11 on the carriage 16 is explained below.

In FIG. 5, the platen roller 5000 guides the recording medium 5200 (e.g., recording paper) from the back side of the figure paper as shown in the figure to the front side of the figure paper. The carriage 16, which moves along the length direction of the platen roller 5000, is provided with a front plate 4000 (2 mm thick) in the front side of the carriage 16, namely the platen roller side, a supporting plate 4003 for electric connection described later, and a registering hook 4001 for fixing the ink-jet cartridge 11 at a predetermined recording position. The front plate 4000 has two projected face 4010 for registration corresponding to the projection 2500, 2600 of the support 300 of the ink-jet cartridge 11, and receives a force perpendicular to the projected face 4010 after the ink-jet cartridge 11 is mounted. Therefore, a plurality of strengthening ribs (not shown in the drawing) are provided on the platen roller 5000 side of the front plate 4000. These ribs also form head-protecting projection portions which project slightly (about 0.1 mm) from the front face position $L_5$ of the mounted ink-jet cartridge 11 toward the platen roller 5000. The supporting plate 4003 has a plurality of strengthening ribs 4004 which are directed vertical to the paper face of the drawing. The projection length of these ribs decreases from the one at the platen roller 5000 side to the one at the hook 4001 side, whereby the ink-jet cartridge 11 is mounted obliquely as shown in the drawing. The supporting plate 4003 has a flexible sheet 4005 provided with pads 2001 corresponding to the pads 201 on the wiring base board 200 of the ink cartridge 11, and a rubber pad sheet 4007 with botches for giving elasticity for pressing the flexible sheet to each pads 2011 from the back side. For stabilizing the electric contact between the pads 201 and the pads 2011, the supporting plate 4003 has a registration face 4006 at the hook 4001 side which exerts a force to the ink-jet cartridge 11 in a direction reverse to the exertion direction of the above projected face 4010. Pad contact is made therebetween, and the deformation of the botches of the rubber sheet 4007 corresponding to the pads 2011 is defined definitely. When the ink-jet cartridge 11 is fixed at the recording position, the registration face 4006 is in contact with the surface of the wiring base board 200. Since the pads 201 are distributed symmetrically regarding the aforementioned line $L_1$, the rubber pad sheet 4007 having botches deformed uniformly, and the contact pressure between the pads 2011 and the pads 201 is stabilized. In this example, the distribution of the pads 201 is in two lines vertically and in two lines laterally.

The hook 4001 has a long slit for engaging with a fixing axis 4009. After counterclockwise rotational movement from the position shown in the drawing by utilizing the moving space, the ink-jet cartridge 11 is registered relative to the carriage 16 by movement to left along the length direction of the platen roller 5000. The movement of the hook 4001 may be made in any manner, but preferably made by a lever manipulation. In any way, in the rotational movement of the hook 4001, the ink cartridge 11 moves toward the platen roller 5000 side to the position where the registering projections 2500, 2600 can be in contact with the projected face 4010 of the front plate 4000. By the lefthand movement of the hook 4001, with hook face at 90° being kept in close contact with the 90° face of the claw 2100 of the ink-jet cartridge 11, the ink-jet cartridge 11 rotates horizontally around the contact region of the projection 2500 with the projection face 4010, finally causing the contact of pads 201 with pads 2011. When the hook 4001 is come to be held at the predetermined position, or a fixing position, the complete contact of the pads 201 with the pads 2011, facial contact of projections 2500, 2600 with the projected face 4010, and facial contact of the hook face 4002 with the 90° face of the claw are realized, thus finishing the mounting of the ink-jet cartridge 11 on the carriage 16.

An outline of the main body of the ink-jet recording apparatus is explained below.

Figure 6:
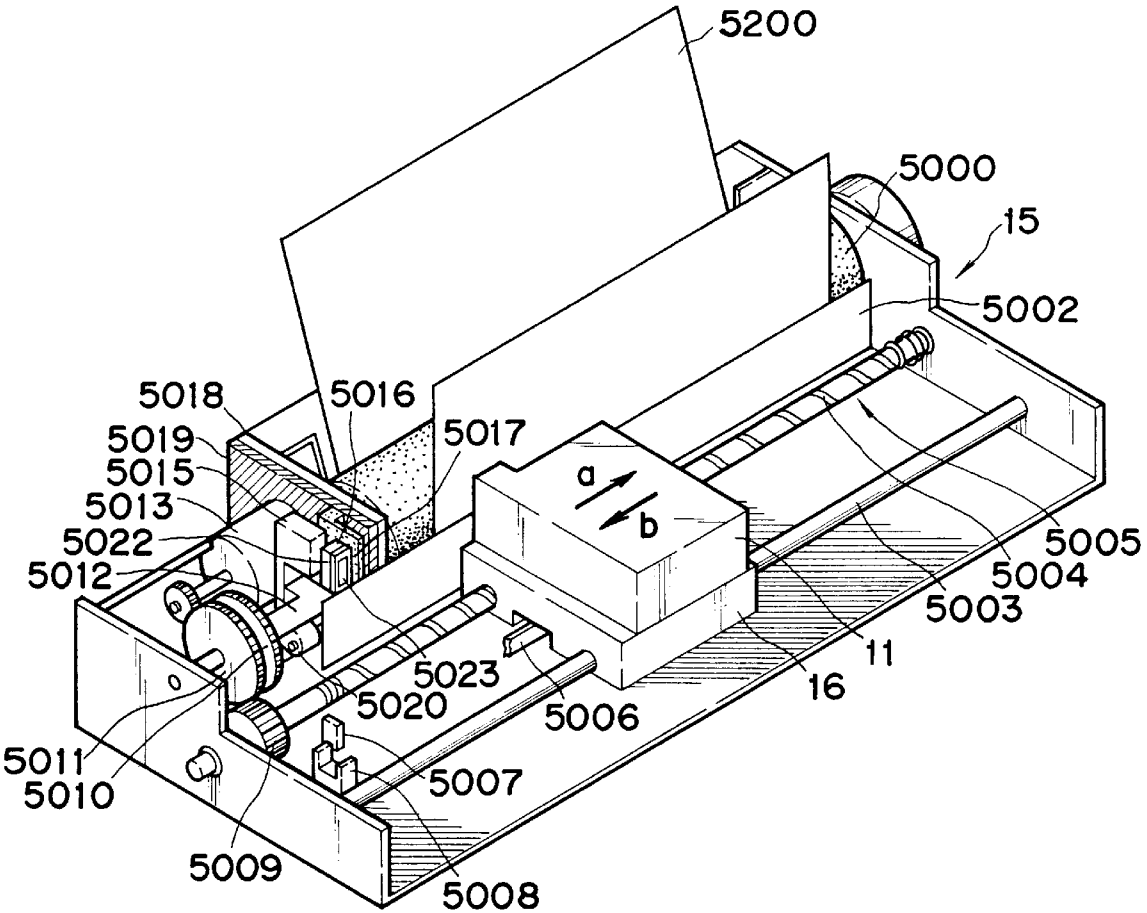
FIG. 6 is a schematic oblique view showing outline of an ink-jet recording apparatus 15.

An appearance of an ink-jet recording apparatus applicable in the present invention is shown in FIG. 6. A leading screw 5005 having a spiral groove 5004 is driven to rotate in normal or reversed direction by interlocking with a driving motor 5013 through driving force-transmitting gears 5011 and 5009. The carriage 16 is engaged with the spiral groove 5004 by a pin (not shown in the drawing) at the mounting portion 5001 (FIG. 5), and is guided slidably by a guiding rail 5003 to move in the direction shown by arrow marks a and b reciprocally. A paper-pressing plate pushes and presses a recording medium 5200 toward the platen roller 5000 throughout the moving direction of the carriage 16. Photocouplers 5007, 5008 constitutes a home-position-detecting means to confirm the position of the lever 5006 of the carriage 16 to be within the region and to control the driving direction, etc. of the driving motor 5013. A capping member 5022 for capping the front face of the ink-jet head 12 is supported by the supporting member 5016 and has a suction means 5015 for recovering suction of the ink-jet head 12 through an opening 5023 in the cap. The main-body-supporting plate 5018 has a supporting plate 5019. A cleaning blade 5017 supported slidably by the supporting plate 5019 is driven forward and backward by a driving means not shown in the drawing. The shape of the cleaning blade 5017 is not limited to the one shown in the drawing, but a variety of known shape of blades are applicable in the present example. The lever 5012 is provided to start the suction-recovery operation, moving with the movement of a cam 5020 engaging with the carriage 16. The movement is caused by the driving force of the driving motor 5013 transmitted by a known transmitting means such as a gear 5010, a shift clutch, and the like.

The respective operations of capping, cleaning, and suction recovery are conducted at the corresponding site by action of the leading screw 5005 when the carriage 16 comes to the home position. Any of the operations are applicable in the present invention, if the operations are conducted at a known timing and with a desired manner. The respective constructions are superior separately or combinedly, and are preferable in the present invention.

As shown in FIGS. 7, 8, 9, 10 and 11, an ink jet cartridge 11 is hermetically encased in a gas-tight container (package container) 60, and marketed.

The container 60 is integrally made from a container body 61 and a cover member 63 by joining and used as a container for encasing the ink jet cartridge 11.

Figure 7:
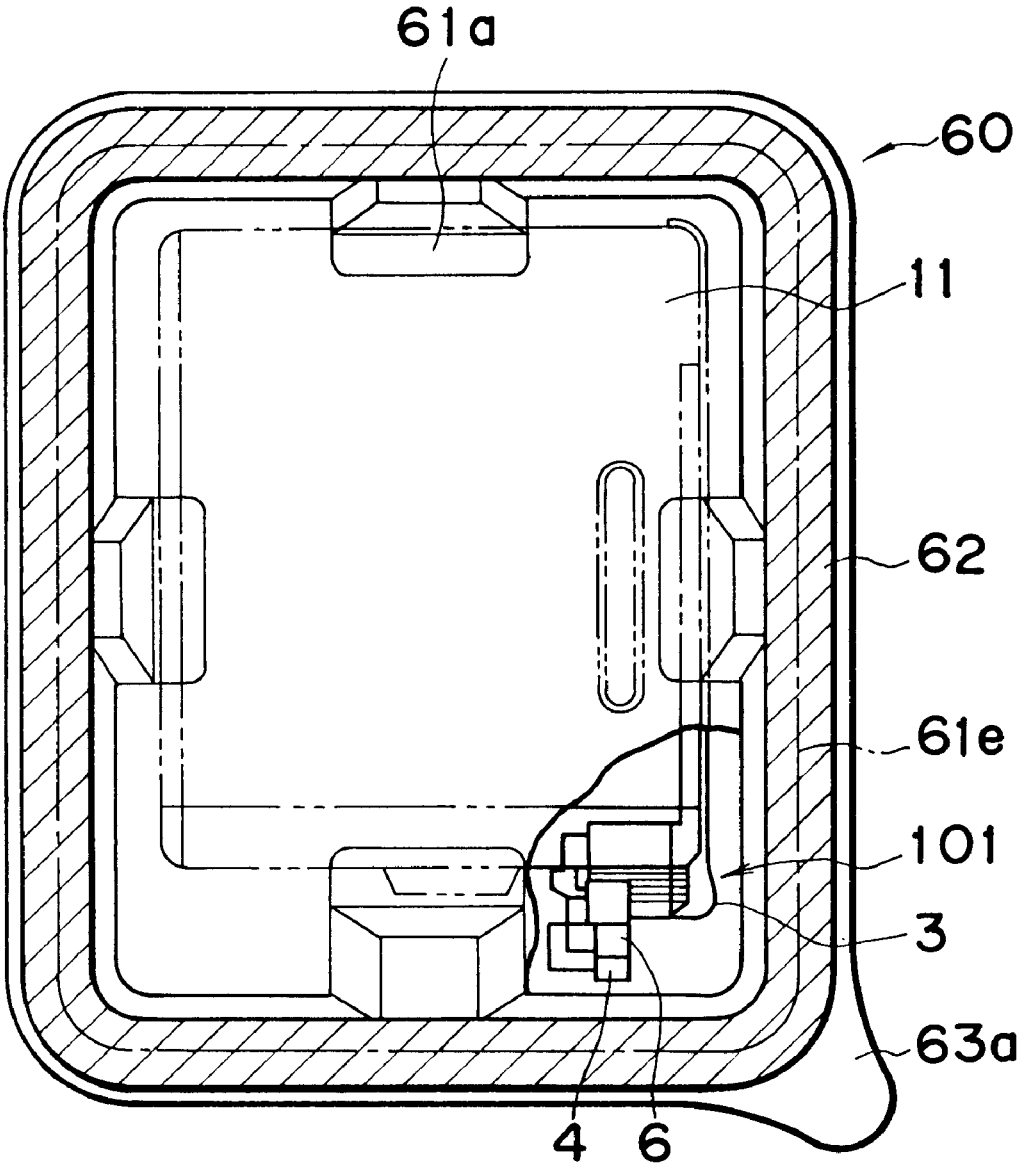
FIG. 7 is a top plan view of containing vessel 60.
Figure 8:
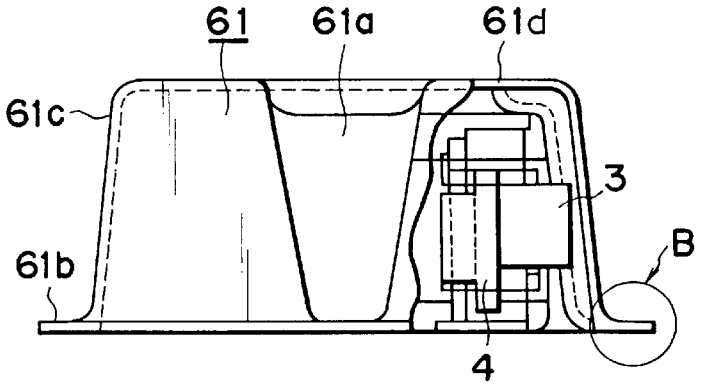
FIG. 8 is a front elevation of containing vessel 60.

The container body 61 is provided with a wall port 61*c* kept in a non-contact state with the ink jet cartridge 11 as a content, convex parts 61*a* projected inwardly from the surface of wall part 61*c* into the content-encasing space to support the ink jet cartridge 11 encased in the encasing space, thereby positioning the ink jet cartridge 11 and a flange part 61*b* for integration with the cover member 63 by joining. The convex parts 61*a* are inward projections when viewed from the inside of the wall parts 61*c* and indentations or concave parts when viewed from the outside of the wall part 61*c*. The recording head part 101 of ink jet cartridge 11 is kept in a non-contact state with the wall part 61*c* in the encasing space. The recording head part 101 can be much more protected by making the projection size of the concave part on the side, on which the recording head part 101 is located, among the four convex parts 61*a* projected into the encasing space, as shown in FIG. 7, to position the recording head part 101 more deep in the encasing space. At the same time, this can prevent users from insertion of an ink jet cartridge 11 into the container 60 in the reversed direction, that is prevent the so called malinsertion.

The wall part 61*c* must have a particularly high strength and thus is made from a material having the necessary strength to a required thickness. The thickness of wall part 61*c* must be properly selected in view of the kind of the constituent material, and is, for example, not less than 0.1 mm, preferably not less than 0.3 mm, more preferably not less than 0.5 mm, and its upper limit is, for example, not more than 1.2 mm.

On the other hand, it is preferable that the convex parts 61*a* have a cushioning property to damp or absorb impacts to protect the content. That is, when the convex parts 61*a* are formed to have the same strength and rigidity as those of the wall parts 61*c*, the impact on the wall part 61*c* is directly and readily transferred to the content, and sometimes may cause a damage to the content. Thus, it is desirable that the convex parts 61*a* are formed to a relatively small thickness and have an elasticity. The thickness of the convex parts 61*a* can be selected as desired in view of the constituent material, and is, for example, not more than 0.8 mm, preferably not more than 0.6 mm, more preferably not more than 0.4 mm, and the lower limit is, for example, not less than 0.05 mm.

As the constituent material for the container body 61, various resins can be used. The container body 61 can be formed from a resin, for example, by integral molding. The integral molding is preferable from the viewpoint of workability, production cost, etc.

For the preparation of a container body 61 by integral molding, injection molding, vacuum molding, etc. of resins can be used. Injection molding of such resins as acrylonitrile-butadiene-styrene copolymer resin (ABS resin), polystyrene, polypropylene, polyethylene, polyethylene terephthalate, etc. is preferable, because it can facilitate adjustment of thickness at the wall part 61*c* and convex parts 61*a* at a lower cost and can readily give desired characteristics at the respective parts.

By providing a flange part 61*b* at the bottom part of the container body 61, joining of the container body 61 with the cover member 63 can be made simply and surely. The flange part 61*b* can be molded together with other parts at the integral molding of the container body 61. The thickness-of the flange part 61*b* can be approximately the same as that of the wall part 61*c*. It is preferable to provide a reinforcing rib 61*e* on the flange part 61*b* and along the bonding area 62 between the container body 61 and the cover member 63. The rib 61*e* is so provided as to be projected towards the cover member 63, but the direction of projection may be reversed. However, the former is preferable, because the joining of the container body 61 with the cover member 63 can be more ensured with the rib 61*e*.

By making the rise parts of the convex parts 61*a* and the wall part 61*c* curve at the corners, as shown in the drawings, the impact dampability can be much improved. The larger the radius of curvature at the curved corners, the better. The radius of curvature can be selected as desired in view of the sizes of the convex parts 61*a*, and is, for example, not less than 2 mm, preferably not less than 3 mm, more preferably not less than 5 mm.

The shape of convex parts 61*a* can be so selected as to effectively conduct the protection of ink jet cartridge 11 and its positioning within the encasing container 60. According to the embodiment shown in the drawings, the ink jet cartridge 11 is supported by four convex parts 61*a*, and this form is most suitable for the protection and positioning of ink jet cartridge 11, and the number of convex parts 61*a* can be selected as desired.

Too large a clearance between the support parts of convex parts 61*a* for the ink jet cartridge 11 and the ink jet cartridge 11 is not preferable, because an unstableness or slippage may occur within the encasing container 60 for the ink jet cartridge 11, whereas too small a clearance is not preferable, because the too small clearance makes it hard to encase the ink jet cartridge 11 into the container body 61 and also makes it easy to transfer an impact from the wall part 61*c* to the ink jet cartridge 11. The clearance can be selected as desired in view of the structure of convex parts 61*a* and compatibility of the convex parts 61*a* to the ink jet cartridge 11, and is, for example, 0.5 mm to 3 mm, preferably about 0.5 mm to about 2 mm.

Materials and thickness of cover member 63 can be selected in view of the weight and strength of ink jet cartridge 11. For the cover member 63, films, sheets or plates of resins or metals, or laminates containing at least one thereof can be used. When the laminate is used for the cover member 63, and when the surface layer of the cover member 63 is made of paper on the non-contact side with the container body 61, the paper may undergo curling deformation owing to release or absorption of moisture from or into the paper, depending on changes in the environment, particularly humidity, and thus it is preferable to provide a moisture-preventing layer such as a film of aluminum, polyvinylidene chloride or polypropylene on the outside side by coating, thereby preventing the deformation. In that case application of a force in the peeling direction can be prevented thereby from the joining area between the container body 61 and the cover member 63 due to the curling deformation.

For the moisture-preventing layer, a film of polypropylene having a thickness of 15 to 100 $\mu$m is most preferable from the viewpoint of cost and strength.

For joining the container body 61 with the cover member 63 after the ink jet cartridge 11 is encased in the container body 61, various joining procedures can be utilized. For example, the container body 61 and the cover member 63 are made from the same kind of resin material and joined together by heat fusion, ultrasonic welding, etc. An easy peel layer can be provided in the area of cover member 63 necessary at least for the joining and their joining can be made through the easy peel layer. By utilizing the easy peel layer, the cover member 63 can be readily removed from the container body 61 when unpacked. Furthermore, the easy peel layer has such an advantage as much less fear for a damage on the ink jet cartridge 11. When maintenance of inside humidity by moisture prevention and easy depacking are taken into account, easy peel is preferable. As the easy peel layer, a layer of various systems such as a hot melt system, a polyethylene system, an ethylene-vinyl acetate copolymer system can be used.

It is preferable in the handling to provide a pickup part 63*a* on the cover member 63 to disengage the container body 61 from the joining. The pickup part 63*a* is provided at a position near the recording head part 101 of ink jet cartridge 11, but provision at a more distant position from the recording head part 101 is preferable to prevent the ink jet cartridge 11, particularly the recording head part 101 to be protected, from touch with figures by mistake when the cover member 63 is pulled apart from the container body 61 through the pickup part 63*a*.

By selecting a suitable constituent material of the present encasing container 60, a function to maintain the humidity atmosphere of the content, that is, a moisture-preventive function or a function to prevent the moisture of the content from evaporation to the outside can be obtained.

For example, by using various resin materials coated with a polyvinylidene chloride layer or an aluminum layer, or materials having an anti-moisture permeation effect, for example, polypropylene, etc. the above-mentioned function to maintain the humidity atmosphere can be obtained. In this respect, polypropylene is preferable from the viewpoints of production cost, moldability, workability, etc.

By using films, sheets or plates of resin or sheets or plates of paper, each coated with a polyvinylene chloride layer or an aluminum layer, or a film of polypropylene of antimoisture permeation likewise as a constituent material for the cover member 63, the function to maintain a good humidity atmosphere can be obtained. To obtain both good functions to damp an impact and maintain a desired humidity atmosphere, it is preferable to use, for example, paper provided with an aluminum layer, a layer for gas-tight sealing of the container body (for example, an easy peel layer) and a poly-propylene layer on the non-contact surface (outside surface) for preventing a curling. Particularly preferable is a laminate provided with an aluminum layer and a polypropylene layer as the outermost layer on the non-contact side from the viewpoints of production cost, and both functions to damp an impact and maintain a desired humidity atmosphere.

When a vacuum molding of polypropylene is used to form the container body 61, the impact damping of container body 61 can be improved by molding the rise parts of convex parts 61*a* and wall part 61*c* with curvatures, as mentioned before, and this is also preferable, because the container body 61 can be thereby given a function to maintain a desired humidity atmosphere, as already mentioned before.

Furthermore, when other parts than the part serving as a ceiling part 61*d* of a raw material sheet are extended in vacuum in the direction of. from ceiling part 61*d* of the container body 61 towards the bottom, i.e. flange 61*b* by male-type molding to mold convex parts 61*a*, wall part 61, curvatures, etc., the respective parts can have a thickness with a higher uniformity and without any occurrence of pinholes. Thus, this is preferable for improving the anti-moisture permeation.

When no curvatures are provided on the container body obtained by vacuum molding, the boundary between the wall part and the convex parts of the container body and the boundary between the wall part and the flange part are formed as corner parts of small thickness with pinholes or with easy occurrence of damages when dropped, or with lowered anti-moisture permeation. Thus, formation of thinner parts can be more effectively prevented by molding the boundary in a curved state, and a better anti-moisture permeation can be more uniformly obtained throughout the entire container body. Furthermore, a stronger periphery against falling shocks can be also obtained thereby.

Figure 12:
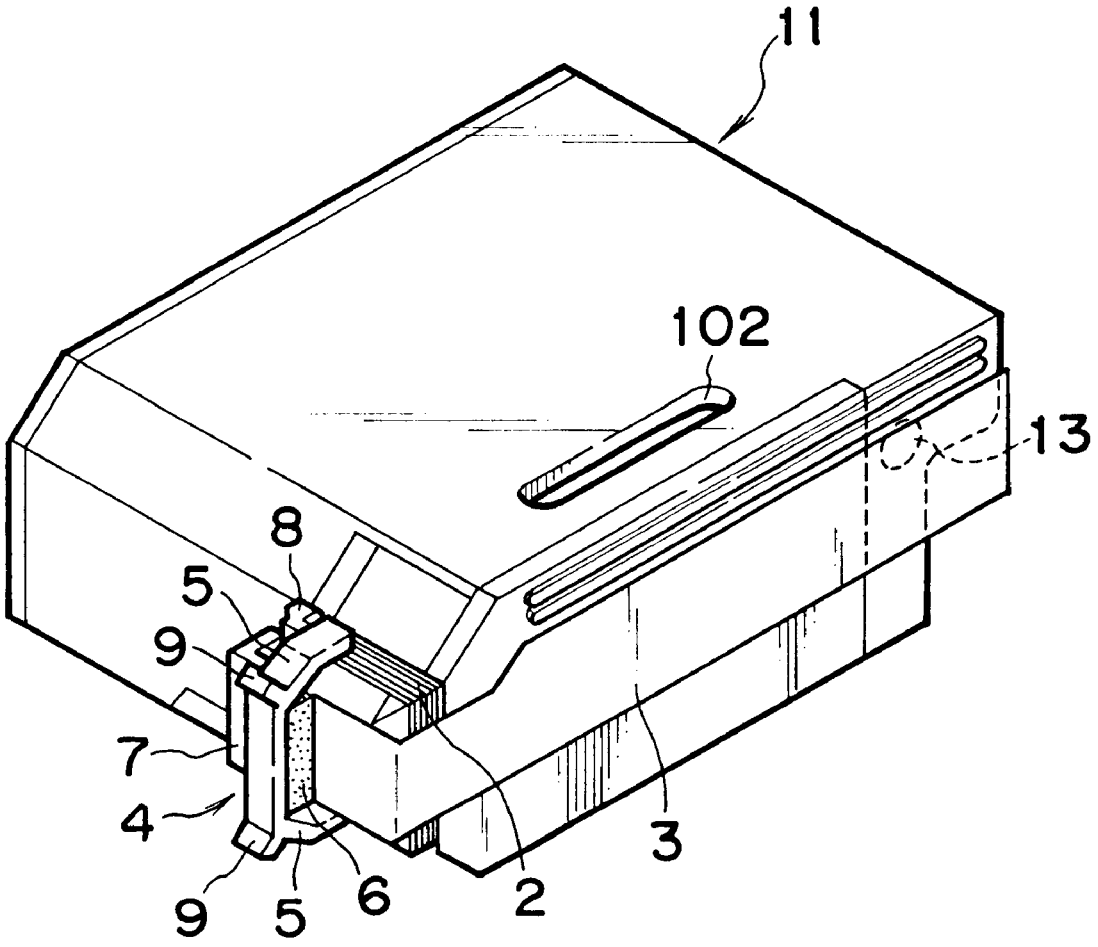
FIG. 12 is a perspective view of the mounting of seal sheet 3' in another example of the present invention.

Fixing mode of seal sheet 3' according to another embodiment of the present invention is shown in FIG. 12. By closing the atmosphere communication opening 13 integrally with discharge outlets 41 in this manner, all the openings to the outside can be covered by the seal sheet 3' to attain substantial prevention of the ink from evaporation.

Description will be made of an ink absorbent member 900.

The present ink absorbent member (which will be hereinafter referred to as "absorbent member") is encased in an ink storage cartridge of an ink jet recording head, and is usually made from a polyethertype polyurethane foam as a polymeric, elastic porous material having continuous foam cells therein. The absorbent member can be prepared by conducting reaction of, for example, polyetherpolyol, dioctyl phthalate, toluene diisocyanate, etc. as starting materials in addition to an additive such as a silicon-based surfactant, etc. according to the conventional process, thereby foaming the reaction product and obtaining a foamed product having a desired porosity, then applying the foamed product to a known film-removal step based on a gas explosion, when required, then heat pressing the product to a desired compression ratio, and cutting the pressed product to a desired size. In the foregoing process for preparing an absorbent member, unreacted starting materials from the foaming step remain as impurities, and distribution of the impurities is made uneven in the pressing step. That is, a high possibility that the resulting absorbent member contains a considerable amount of unevenly distributed impurities necessitates a washing treatment of the absorbent member.

In the present invention, the absorbent member refers to those having the same sizes as directly after the heat pressing and those cut to a desired sizes. The organic polar solvent incapable of reacting with the absorbent member is a polar solvent having a low volatility and no substantial influence on the absorbent member itself, and includes, for example, alcohols, ketones, ethers, nitrogen-containing solvents. Such solvents as those capable of dissolving or attaching urethane polymers as structural members of the skeleton of the absorbent members are not appropriate. The present solvent must well dissolve the impurities. In view of the above-mentioned conditions, some of alcohols and ethers can be used preferentially. Particularly effective among them are, for example, monohydric alcohols having not more than 3 carbon atoms and alkyl ethers of polyhydric alcohols. The monohydric alcohols include, for example, methanol, ethanol, propanol, etc., and the alkyl ethers of polyhydric alcohols include, for example, methylcellosolve, ethylcellosolve, methylcarbitol, ethylcarbitol, triethyleneglycolmonomethylether, etc. These solvents, even if retained in a trace amount after the washing, give no serious influence on the physical properties of ink.

These solvents can be used above or in combination of at least two thereof, or can be used as a solvent mixture with water. Particularly, the solvent mixture with water is more preferable from the viewpoint of safety. When the solvent mixture with water is used as a washing agent, a mixing ratio of water to the organic solvent by weight is approximately 9:1 to 1:9, preferably approximately 7:3 to 1:1, where a satisfactory washability can be maintained.

Involatile impurities existing in the absorbent member (where other substances than the urethane polymers constituting the skeletons of the absorbent member will be hereinafter referred to as "impurities" to designate soluble matters, that is, the matters soluble in an ink) can be effectively removed with the above-mentioned polar solvent, because it seems that the polar solvent can well permeate into the urethane polymer constituting the skeletons of the absorbent member to efficiently extract the unreacted monomers, etc. or to dissolve these impurities well therein.

Relations between the solvent and the impurities dissolved in the solvent will be described below together with the principle of a procedure for determining the impurities in the present invention.

Figure 13:
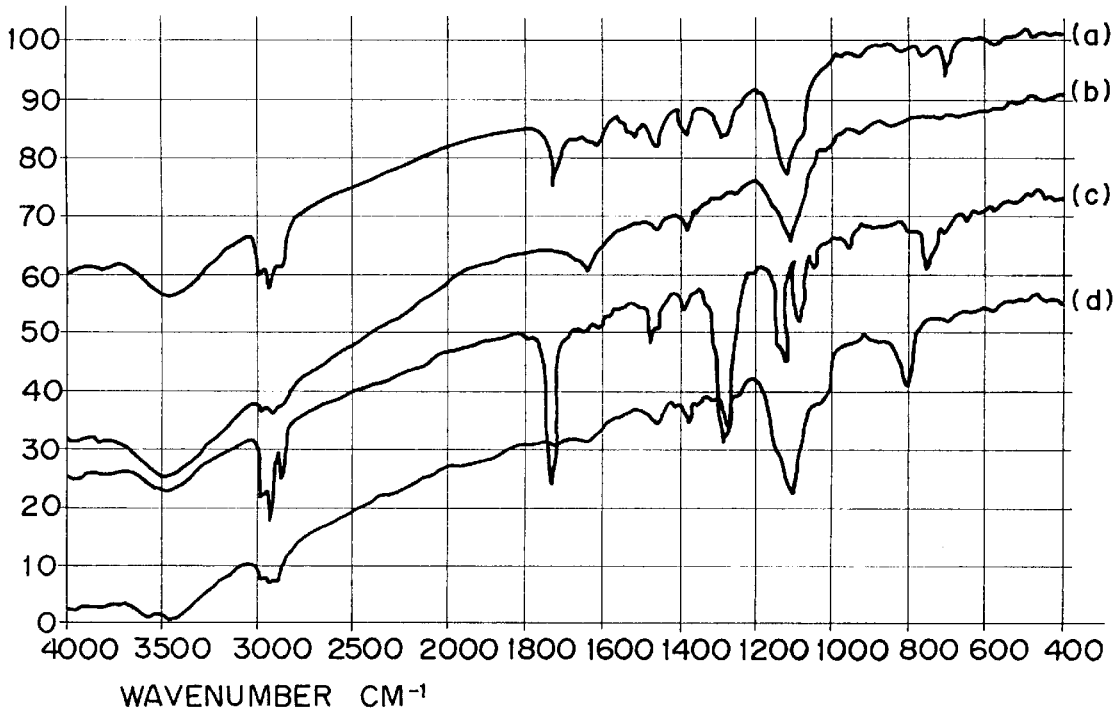
FIG. 13 is an IR spectrum of each of extracts.

FIG. 13 shows one example of results from component analysis of impurities by washing the absorbent member obtained according to the conventional process with ethanol, evaporating the ethanol washing solution to dryness and subjecting the sticky residues to infrared absorption (IR) spectroscopy (KBr tablet method), while conducting the same infrared absorption spectroscopy of polyetherpolyol, dioctyl phthalate and silicon-based surfactant as urethane foam raw materials and an additive, respectively, at the same time. IR spectroscopy is quite simple. and can easily identify compounds through characteristic peaks. Comparative study of spectra of the resulting dissolved matters in the solvent reveals that the dissolved matters are mainly polyetherpolyol and dioctyl phthalate, where particularly polyetherpolyol is dominant. That is, it can be concluded from FIG. 13 that in the infrared spectrum (a) of dissolved matters from the absorbent member, the presence of dioctyl phthalate in (c) is shown by the presence of peak due to the carbonyl group at 1730 $cm^{-1}$, and the presence of polyetherpolyol in (b) and silicon-based surfactant in (d) is shown by the presence of peak due to the ether bond at 1110 $cm^{-1}$, but there is no peak in (a) at 800 $cm^{-1}$ as a characteristic absorption peak of silanol group, and thus the dissolved matters are mainly polyetherpolyol and dioctyl phthalate in the spectrum (a). Furthermore, comparison of peak depth at 1730 $cm^{-1}$ with that at 1110 $cm^{-1}$ in the spectrum (a) reveals the difference in the quantity, from which it is obvious that most of the impurities in the dissolved matters from the absorbent member is polyetherpolyol.

The above-mentioned results show that a solvent capable of highly dissolving polyetherpolyol is preferable as a washing agent for the foam. As a result of search for good solvents for the polyetherpolyol, it was found that the above-mentioned monohydric alcohols and alkylethers of polyhydric alcohols were particularly preferable. In the dissolution of impurities, ethanol was used, and it was also found that water had a solubility for the impurities, though not high, and thus a solvent mixture with water was also effective, as mentioned before.

It was found from the foregoing results and other results that the quantity of impurities in the absorbent member could be effectively determined as a quantity of soluble matters from changes in the peak depth at 1110 $cm^{-1}$ due to the ether bond of polyetherpolyol.

The foregoing procedure is applicable to selection of kinds of the washing agents and washing conditions in the present invention, and thus appropriate kind of the washing agent and washing condition must be selected in view of absorbent members to be used.

Determination by IR spectrum may be made not only with the peak at 1110 $cm^{-1}$, but also with that at 1730 $cm^{-1}$.

The procedure for quantitative determination of soluble matters will be explained in detail below.

For example, one absorbent member is washed with a given amount of a washing agent under given conditions, and then a predetermined amount of the washing solution is sampled and evaporated to dryness. Then, the residues are formed in a KBr tablet for the infrared spectroscopy, and the tablet is inserted into an infrared spectrometer to obtain a spectrum. A peak depth at 1110 $cm^{-1}$ is recorded. On the other hand, predetermined amounts of polyetherpolyol are sampled and formed into KBr tablets and their infrared absorption spectra are obtained, and their peak depths at 1110 $cm^{-1}$ are recorded. By preparing a calibration chart between the amount of polyetherpolyol and the peak depth from the peak recordings, a quantity of soluble matters can be obtained on the basis of different washing conditions.

Figure 14:
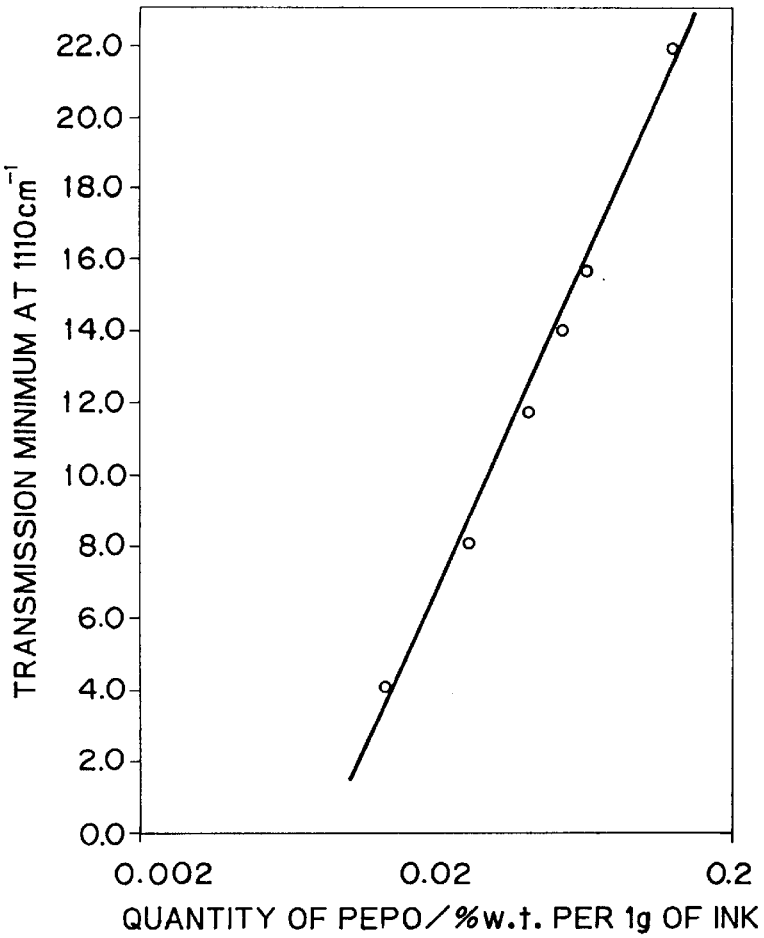
FIG. 14 is a calibration curve of polyether polyol.

FIG. 14 slows one example of the calibration chart.

Relations between the measurements by the foregoing procedure for the quantitative determination with the peak at 1110 $cm^{-1}$ in the IR spectrum for polyetherpolyol as an impurity, and the physical properties of ink will be explained below.

Inconveniences appearing when an unwashed absorbent member is used are a decrease in the surface tension as one of ink physical properties, to, for example, less than 40 dynes/cm, and deterioration of recording quality. Particularly, an OD decrease in the recording quality, ink permeation to the back side of paper and spreading of ink in a whisker state around the recording dots appear, resulting in deterioration of sharpness in the recording (irregular blurrings). In order to suppress the deterioration of the recording quality and the decrease in the ink surface tension, it is necessary that the amount of impurities (soluble matters) be not more than 0.04% by weight, preferably not more than 0.03% by weight per gram of ink, as will be explained later. The amount of impurities per gram of ink means an amount of impurities dissolved into ink per gram of ink in the ink tank.

As will be described later, above 0.04% by weight, the deterioration of recording quality gradually proceeds during the immersion of an absorbent member in ink for a long time, and thus the recording quality is deteriorated after 2 or 3 years, though it is relatively high in the initial period. At not more than 0.04% by weight, no deterioration is observable in the recording quality even if the absorbent member is immersed in ink for 2 to 3 years, and the decrease in the ink surface tension can be suppressed to a minimum. That is, it is not less than 40 dynes/cm.

Relations between the quantity of soluble matters from an absorbent member and the recording quality can be determined by preparing absorbent members having various quantities of soluble matters in advance and quantitatively determining the quantities of dissolved matters according to the above-mentioned procedure for quantitative determination by infrared absorption spectroscopy.

As to the standard for the cleaning degree of an absorbent member, i.e. concentration of impurities of not more than 0.04% by weight per gram of ink, the quantitative determination of polyetherpolyol is preferred from the viewpoint of simpleness, reliability, etc. of determination procedure. So far as the above-mentioned polar solvent is used as a washing agent in the present invention, washing can be carried out on the basis of a similar standard by determining the dissolved matters as a weight change simply through evaporation of the dissolved matters-containing fraction to dryness (50° to 90° C.). Besides the procedure for determining polyetherpolyol by the peak at 1110 $cm^{-1}$, total of polyetherpolyol and dioctyl phthalate can be quantitatively determined from combination with other peaks, e.g. peak at 1730 $cm^{-1}$, where the determination can be easily made by preparing a necessary calibration chart for it in advance.

The present washing step in the preparation of an absorbent member will be explained below.

The present washing step can be carried out after the heat pressing step or after the cutting step. In case of washing after the cutting step, it is a standard that the absorbent member has a thickness of usually about 20 to about 35 mm, and the size of the absorbent member is selected in view of the size of an ink storage cartridge in the ink jet cartridge in case of washing after the cutting step. From the viewpoint of washing efficiency, the size of the absorbent member must not be too large, and usually is 5.5 to 6.5 g/piece as the standard.

A predetermined weight of absorbent member is washed with several to several tens of rubbing, repeated pressing or ultrasonic waves with a predetermined amount of a washing agent. Usually, one run of the washing is satisfactory, and preferably one washing is repeated with a fresh washing solution after the washing with the predetermined amount of the solvent. After the washing with the washing agent, the washing agent contained in the absorbent member is squeezed out and directly dried with heating or rinsed with pure water, and the water contained in the absorbent member-is squeezed out, followed by drying with heating. It is satisfactory that the content of impurities is below the predetermined limit value.

The amount of a washing agent for use in the washing is preferably 4 ml to 10 ml/gram of the absorbent member. Below 4 ml/gram of the absorbent member, the washing is not satisfactory, resulting in increased runs of washing and increased time with a poor efficiency, whereas above 10 ml/gram of the absorbent member, the amount of the solvent is too large with no corresponding washing effect and a poor cost efficiency.

Satisfactory washing time is usually a few ten seconds to a few minutes. In case of washing by rubbing or repeated pressing, a few ten seconds are satisfactory. After the washing, drying is carried out preferably in a hot air drier at 40° to 100° C., preferably at 50° to 70° C., because drying at a high temperature may lead to deterioration of the quality of the absorbent member. An appropriate drying time is 3 to 6 hours. In any way, appropriate washing conditions must be preset by the above-mentioned IR spectroscopic procedure to make the amount of impurities not more than 0.2% by weight per gram of the ink absorbent member by washing. The washing step can be systematized thereby.

The present absorbent member is a foamed member having a predetermined porosity prepared according to the predetermined process, followed by heat pressing to a predetermined compression ratio and cutting to a predetermined size. In the heat pressing step the size is compressed to one-half to one-fifth of the original size usually at a temperature of 190° to 210° C. It has been found by the IR spectroscopic procedure that the thus obtained absorbent members have varied contents of impurites (soluble matters), depending on the cutting positions of a foamed block before the heat pressing. This finding is not known before and very important for stably preparing absorbent members of constant quality. The present invention can meet such uneven distribution of impurities.

Changes with time in the recording quality can be determined by an accelerated test based on preservation at 60° C. for 1 to 3 months, which corresponds to the preservation at room temperature for 1 to 3 years. That is, by inserting the absorbent member into an ink jet cartridge and keeping the cartridge in an oven at 60° C., and recording the data at every month, the changes with time in the recording quality can be determined.

Experiments were carried out under various washing conditions to determine relations between the content of remaining impurities after the washing and changes with time in the recording quality. The present invention will be explained in further detail below.

(1) Experiment 1

EXAMPLE 1

There were prepared two absorbers (absorbent members), which were obtained by taking out a part of the center of a polyurethane foaming block obtained by a routine method, effecting hot-press at 200° C. for compressing the part to one third, and cutting out a rectangle chip of a weight of 6 g. The two absorbers were press-washed in 80 cc of ethanol ten times (about 0.5 to 1 minute in total), and ethanol penetrated into the absorbers was pressed out to obtain the washed absorbers and the waste ethanol washing solution. A 0.2 ml sample was taken from the obtained waste ethanol washing solution and evaporated to dryness. The residue was thoroughly ground and mixed in an agate mortar, together with 200 mg of the KBr powder for infrared absorption spectrum. According to a routine method, the KBr powder obtained was prepared into a KBr tablet for infrared absorption spectrum, by means of a KBr tablet machine. The infrared absorption spectrum of the tablet was measured by an IR spectrometer Type HITACHI 270-30, to read out its peak depth at 1110 $cm^{-1}$ by a routine method. By using the value, the amount of extract was calculated on the basis of the calibration curve in FIG. 14. The two washed absorbers were then placed and press-washed in 200 cc of pure water ten times. The absorbers were pressed and then dried in hot air in an oven at 60° C. for 5 hours. One of the resulting washed absorbers was placed subsequently in 40 cc of ethanol, and by following the same procedure at the initial stage, the extract amount in the ethanol washing solution was measured by infrared absorption spectroscopy. The total amount of the extract described immediately above and the extract described further above was defined as the contact of the initial eluted matters (total extract). The remaining one absorber was inserted into an ink cartridge for constructing an inkjet head, which was then subjected to a recording test. The recording test was performed at ambient temperature and humidity, initially and after the storage at 60° C. for one month, two months and three months. The OD value, strike-through of ink, and quality (irregular bleeding of dots) were then evaluated as compared with those at initial stages. The storage at 60° C. for three months corresponds to the storage at ambient temperature for three years.

The standard for evaluation was as follows;

◎: no change

○: small change (within the allowable limit)

Δ: medium change (beyond the allowable limit)

X: large change.

The results are shown in Table 1.

As a result, the impurities remaining after the washing were 0.07 wt % per g of ink absorber. No effect on ink quality was observed even after the storage for three months.

EXAMPLE 2

Three absorbers of the same type as in Example 1 were used. One of them was washed in ethanol as in Example 1, and the total amount of extract in the washing solution was measured. The remaining two were washed in a washing solution of a weight ratio of isopropyl alcohol to water of 1:1, by the same method as in Example 1. One of the absorbers obtained after the washing was further washed in 40 cc of ethanol in the same manner as in Example 1, and the amount of extract in the washing solution was measured. The remaining one absorber after the washing was incorporated in an inkjet head as in Example 1, which was then subjected to the recording test. The results are shown in Table 1.

Consequently, the impurities remaining after the washing were 0.1 wt % per g of ink absorber. No effect on ink quality was observed even after three-month storage.

EXAMPLE 3

By employing as a washing solution the mixed solvent of methyl cellosolve and water of a weight ratio of 1:1 instead of the mixed solvent of isopropyl alcohol and water of Example 2, washing was carried out following the same procedure in its entirety as in Example 2. The recording test was then carried out. The results are shown in Table 1.

Consequently, the impurities remaining after the washing were 0.09 wt % per g of ink absorber, and no effect on ink quality was observed after three-month storage.

EXAMPLE 4

By employing absorbers obtained by taking out a part of the lower part of a polyurethane foaming block, effecting hotpress at 200° C. for compressing the part to one-third, and cutting out a rectangle chip of a weight of 6 g, washing was done, completely following the same method of Example 1. The amount of extract was then measured. The recording test was subsequently carried out. The results are compiled and shown in Table 1.

As a result, the impurities remaining after the washing were 0.15 wt % per g of ink absorber. A slight change was observed in ink quality during three-month storage, but it was within the allowable limit. Thus, it did not cause any problem.

EXAMPLE 5

One of the same absorbers as in Example 2 was washed in ethanol, and the total weight of extract in the washing solution was measured. The remaining two absorbers were washed in the washing solution used in Example 2, and ultrasonic cleaning was employed as the washing method. By using a 100-W ultrasonic cleaner Type RU-30C, washing was effected for two minutes. By the same manner as in Example 2, the extract amount was measured while the recording test was done. The results are compiled and shown in Table 1.

Consequently, the impurities remaining after the washing were 0.12 wt % per g of ink absorber, and no effect on ink quality was observed after three-month storage.

EXAMPLE 6

The same washing procedure was carried out two times, instead of once in Example 5. Then, two washed absorbers were obtained. One of them was press-washed in 40 cc of ethanol ten times, and the waste ethanol washing solution was obtained. A 0.2 ml sample was taken from it, and its infrared absorption spectrum was measured in order to calculate the extract amount as in Example 1. The remaining one was incorporated into an inkjet head. The results of the recording test performed in the same manner as in Example 1 are compiled and shown in Table 1.

Consequently, the impurities remaining after the washing were 0.03 wt % per g of ink absorber, and no problem concerning long-term storage of the ink absorbers was observed.

EXAMPLE 7

By employing absorbers obtained by taking out a part of the lower part of a polyurethane foaming block, effecting hotpress at 200° C. for compressing the part to one-third, and cutting out a rectangle chip of a weight of 6 g, washing was carried out as in the same manner as in Example 2, and the amount of extract was measured. The recording test was subsequently carried out. The results are compiled and shown in Table 1.

As a result, the impurities remaining after the washing were 0.19 wt % per g of ink absorber. Even after two-month storage, the change in ink quality was within the allowable limit.

EXAMPLE 8

By employing absorbers obtained by taking out a part of the lower part of a polyurethane foaming block, carrying out hot-press at 210° C. for compressing the part to one-third, and effecting washing as in the same manner as in Example 7, the amount of extract was measured. The recording test was then carried out. The results are compiled and shown in Table 1.

As a result, the impurities remaining after the washing were 0.20 wt % per g of ink absorber. After two-month storage, the change in ink quality was within the allowable limit.

Comparative Example 1

Absorbers as used in Example 1 were assembled into an ink-jet head without washing to carry out the recording test. The results are compiled and shown in Table 1.

Consequently, the change in ink was distinct after one-month storage, so it was not permissible. Comparative Example 2.

Absorbers as used in Example 4, but not through washing process, was assembled into an ink-jet head to carry out the recording test. The results are compiled and shown in Table 1.

Consequently, the change in ink was already evident at the initial evaluation.

Reference Example

Absorbers as used in Example 1 were washed in ethanol three times following the same method in Example 1. Five absorbers obtained through thorough washing were prepared (Nos. 1 to 5) and assembled individually into ink-jet heads. To the absorbers of Nos. 1 to 4 was added polyether polyol (propylene oxide adduct of glycerine, having a molecular weight of about 6000) at a ratio of 0.1 wt %, 0.15 wt %, 0.2 wt % and 0.25 wt % per g of absorber, respectively.

No-additive ink was added to the absorber No. 5, for carrying out the recording test. The results are compiled and shown in Table 1.

Consequently, a tendency similar to the results of the examples of the present invention was observed. The effect of the loadings of the impurities above 0.2 wt % per g of absorber on ink was not permissible.

From the results of the experiments above, it is thus demonstrated that there can be obtained ink absorbers with no enviromental problem and without deteriorating the recording quality, by carrying out washing with a washing agent containing an organic solvent of a polarity, the organic solvent having no reactivity with ink absorbers, in such manner that the extract amount should be 0.2 wt % or less per g of ink absorber.

(2) Experiment 2

Correlation of the amount of polyether polyol extracted from an ink absorber into an ink with the recording quality was examined.

Figure 9:
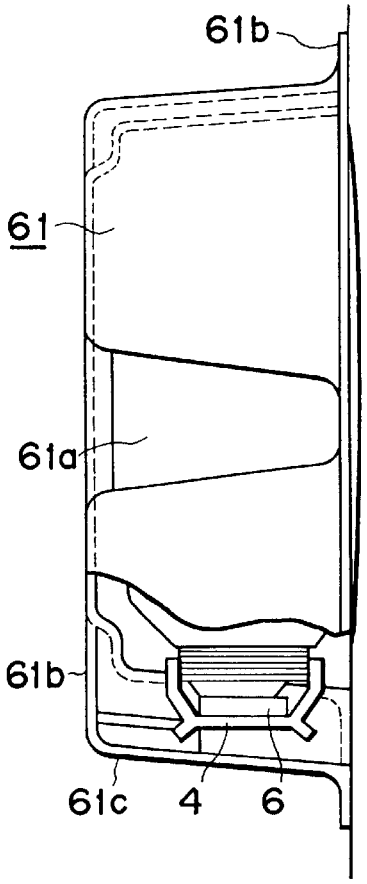
FIG. 9 is a right side view of containing vessel 60.
Figure 10:
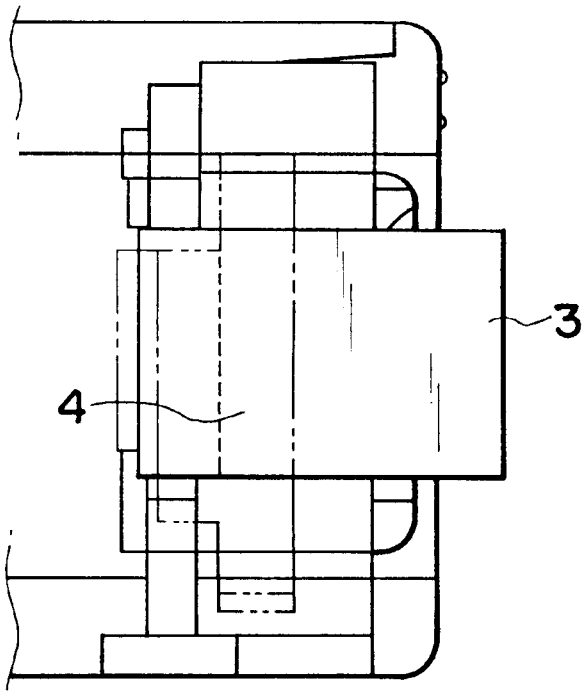
FIG. 10 is an enlarged fragmentary view representing the state of placing a recording head part 101.
Figure 11:
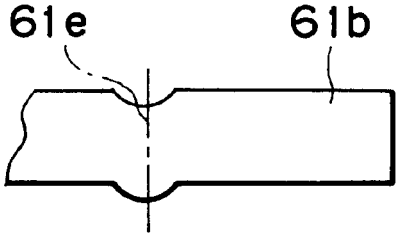
FIG. 11 is an enlarged view of Part B in FIG. 8.

Ink absorbers (ether-type foaming polyurethane) were individually prepared, with varying amounts of organic matters (polyether polyol) extracted into an ink as shown in FIG. 9. These ink absorbers were prepared, by hot-press under various conditions so as to compress the ether foaming polyurethane to one third and cutting.

These ink absorbers were individually charged into ink tanks of inkjet cartridges to allow them to absorb and keep 30 $cm^3$ of ink maintained at pH 8–10. They were then left to stand for a while. Subsequently, recording was done by using these ink-jet cartridges. Recording quality was then evaluated, and the amount of organic matters (polyether polyol) extracted into ink was measured. The weight of each of the ink absorbers was 6 g.

As has been described above, the amount of extracted polyether polyol was determined by infrared absorption spectroscopy. Such determination was also carried out by high-performance liquid chromatography described hereinbelow. A liquid chromatography system Shodex Type ds-3 was used, while a column of Shodex Type B-806 of an ion exchange type was employed. A detector Shodex Type RI SE-51 of a refractive index type was used. A solvent of methanol and water of 6:4 was used, and its flow rate was 1 ml/minute. The extract amount shown in FIG. 15 is calculated based on the weight (6 g) of the ink absorber.

The overall recording quality was evaluated from the respects of the decrease in optical density due to ink bleeding (feathering) and strike-through (ink penetration toward the back of paper when the entire surface was recorded in black). The evaluation divided in 4 stages of A to D was carried out, according to the method of functional test. A, B, C and D correspond to the levels excellent, good within the allowable range of recording quality, poor outside the allowable range of recording quality, and considerably poor, respectively (FIG. 15).

Figure 15:
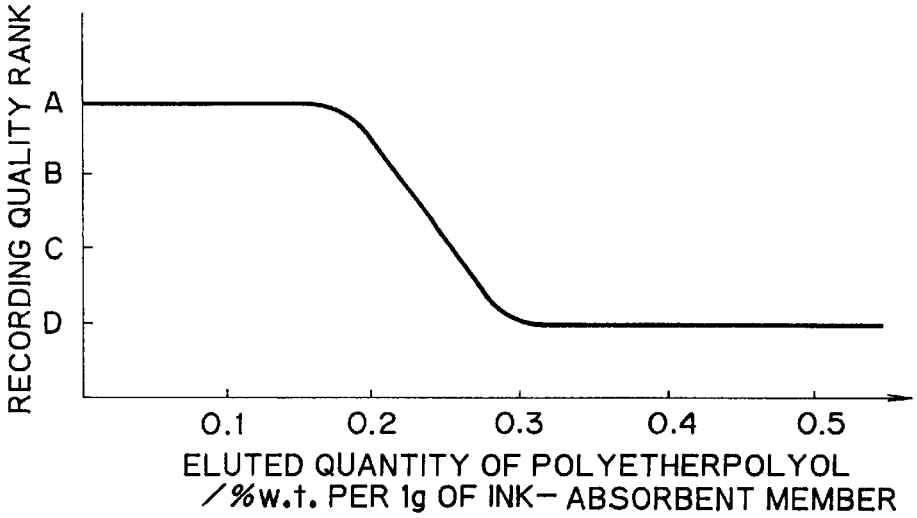
FIG. 15 is a characteristic figure representing the relation between the extract amount of polyether polyol and the recording quality.

FIG. 15 shows that the deterioration of recording quality cannot be induced if the amount of extracted polyether polyol is 0.2 wt % or less per g of ink absorber and thus satisfactory recording quality can be maintained. If the amount of extracted polyether polyol exceeds 0.2 wt % per g of ink absorber, recording quality is dramatically deteriorated.

The Experiments 1 and 2 demonstrate that the deterioration of recording quality is not induced if the amount of polyether polyol extracted into an ink is 0.2 wt % or less per g of ink absorber.

(3) Experiment 3

Figure 16:
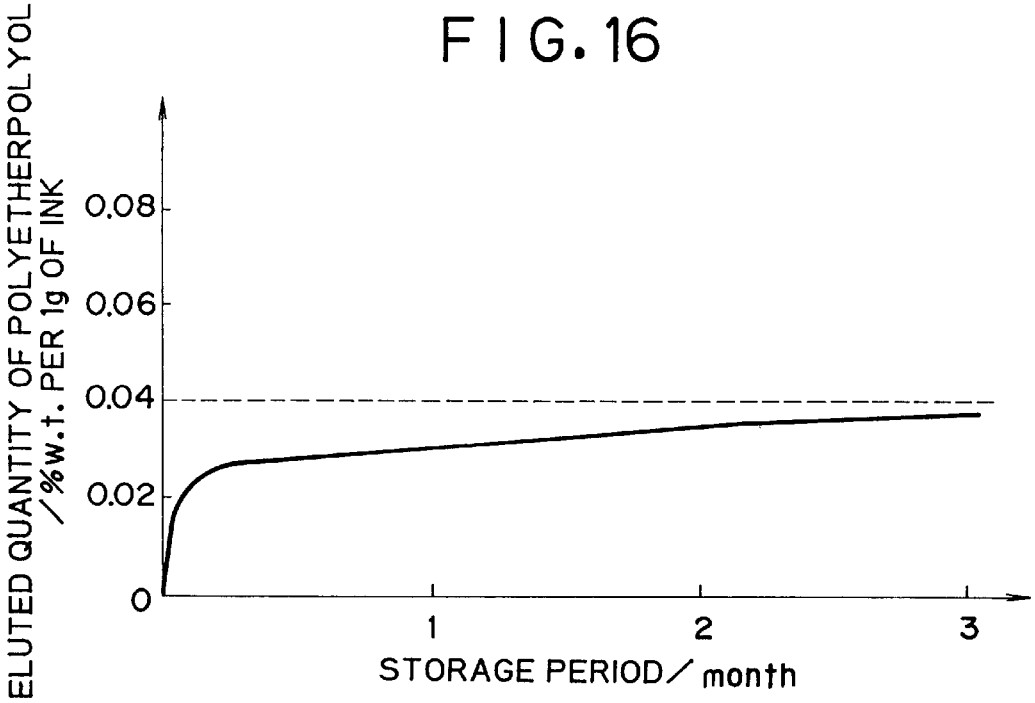
FIG. 16 is a characteristic figure representing the relation between the extract amount of polyether polyol and the storing time.

By the same manner as in Example 2, an ink absorber with an extract amount of 0.2 wt % per g of ink absorber was charged in an ink tank to allow the absorber to be impregnated with ink maintained at pH 8 to 10. Regarding the ink-jet cartridge, the relation between the storage period at a temperature of 60° C. and the amount of polyether polyol extracted into ink was examined. The method for measuring the elution amount is the same as in Example 1. The results are shown in FIG. 16. The storage at 60° C. for one month corresponds to the storage at room temperature for one year.

As is apparent from the results, the elution amount of polyether polyol gradually increases under long-term storage, but does not exceed 0.2 wt % per g of ink absorber for a period of at least about 3 years which is the converted period at room temperature.

Based on the experimental results carried out by the present inventors, there will be explained the relation between the hot-press temperature of an ink absorber using ether-type foaming polyurethane in accordance with the present invention and the extract amount of polyether polyol. In the following Examples 4 to 7 and Comparative Example 3, the term ether-type foaming polyurethane represents a product produced by the process comprising, employing propylene oxide adduct of glycerine, having a molecular weight of about 6000, and toluene diisocyanate as polyether polyol and diisocyanate, respectively, polymerizing and foaming these materials by a known method, forming them into open cells by a known membrane-removing process, and cutting out the cells-into a preset thickness.

(4) Experiment 4

The correlation between the amount of polyether polyol extracted from an ink absorber into an ink and the recording quality was examined.

An ether-type foaming polyurethane was hot-pressed to compress it to one-third at each temperature of 210, 200, 190 and 180° C., which was then cut out into ink absorbers. The individual ink absorbers were charged in ink tanks of ink-jet cartridges, and allowed to absorb and keep 30 $cm^3$ (about 30 g) of ink. After the absorbers were left to stand for a while, recording was effected by using these ink-jet cartridges. The recording quality was evaluated, to measure the amount of polyether polyol extracted into the ink at that time. The weight of each of the ink absorbers was 6 g.

Overall recording quality was evaluated from the respects of the decrease in optical density due to ink bleeding (feathering) and strike-through (ink penetration toward the back of paper when the entire surface was recorded in black). According to the method of functional test, the evaluation divided in 4 stages of A to D was carried out. A, B, C and D correspond to the levels excellent, good within the allowable range of recording quality, poor outside the allowable range of recording quality, and considerably poor, respectively.

The extract amount of polyether polyol was determined by high-performance liquid chromatography, and was represented by the concentration by weight per weight of ink absorber. A liquid chromatography system of Shodex Type DS-3 was used, while a column of Shodex Type B-806 of an ion exchange type was used. A detector, Shodex Type Rl SE-51 of a refractive index type, was used. A solvent of methanol and water of 6:4 was used, and its flow was 1 ml/minute.

The results are shown in FIG. 15. It is apparently shown in the graph of Experiment 4, that the deterioration of recording quality cannot be induced if the extract amount of polyether polyol is 0.04 wt % or less per ink (0.20 wt % or less per g of ink absorber) and thus satisfactory recording quality is maintained. It is also confirmed, that if the elution amount of polyether polyol exceeds 0.04 wt % per g of ink, recording quality is dramatically deteriorated. Thus, the level 0.04 wt % per g of ink (0.20 wt % per g of ink absorber)

was determined as the upper limit of the deterioration of recording quality, concerning the amount of polyether polyol extracted into ink.

(5) Experiment 5

The correlation between the hot-press temperature and the extract amount of polyether polyol from an ink absorber into ink was examined.

Figure 17:
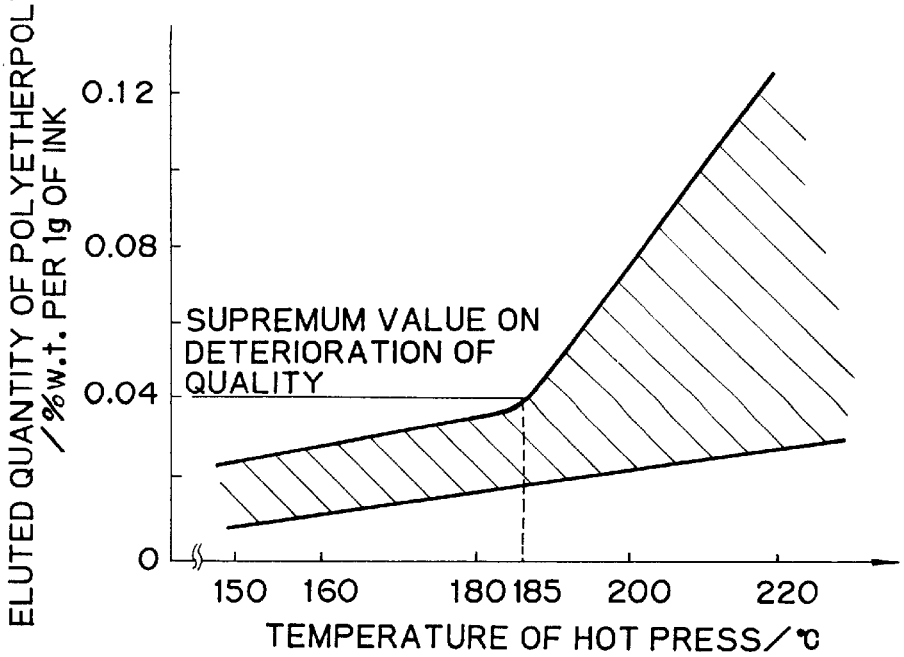
FIG. 17 is a characteristic figure representing the relation between the temperature of hot-press and the extract amount of polyether polyol.

Ink absorbers produced by hot-pressing ether-type foaming polyurethane at various temperatures were prepared, and ink was absorbed into the absorbers as in Example 4 to measure the extract amount of polyether polyol. In order to facilitate the extraction of polyether polyol, the ink absorbers were compressed repeatedly by rubbing and washing. By such procedure, the state is reproducible where the polyether polyol is extracted after a certain period of time has passed from the impregnation and absorption of ink. The results of the measurement carried out on a great number of ink absorber samples are shown in the hatched area of FIG. 17.

As is apparently shown from the results, the elevation of the hot-press temperature increases the extract amount of polyether polyol, and the variation in the production increases if the hot-press temperature exceeds 185° C. On taking account of the variation in the production, it is apparent that the hot-press temperature should be 185° C. or less, in order that the extract amount of polyether polyol is below the upper limit (0.04 wt % per g of ink) of the deterioration of the recording quality described above.

(6) Experiment 6

The correlation between the temperature and the time of hot-press was examined.

Hot-press was performed to compress ether-type foaming polyurethane to one-third at each temperature of 140, 150, 160, 170 and 180° C. The minimum of the hot-press time required for leaving the deformation due to hot-press, was then measured.

Consequently, no effect of hot-press was observed in case that hot-press was carried out at 140° C., or the deformation by hot-press did not remain even if the hot-press was continued for a considerably long time. When the temperature of hot-press was 150° C., the period of hot-press required was 2 hours; when the temperature of hot-press was 160° C., the period for hot-press was 90 minutes; the temperature of hot-press was 170° C., the period for hot-press was 1 hour and when the temperature of hot-press was 180° C., the period for hot-press was 30 minutes. As is thus shown, the hot-press temperature was required to be 150° C. or more.

When the hot-press was carried out at 150° C., distinct spring back was observed. When the hot-press was carried out at 160° C., spring back was slight.

In case that ether-type foaming polyurethane was used as ink absorbers, as is apparent from Experiments 4 to 6 described above, the period for hot-press did not get too long and the extract amount of the polyether polyol was lower if the hot-press temperature was 150° C. or more and 185° C. or less. The recording quality can thus be maintained well, even without washing process. On taking account of the period for hot-press and the spring back at hot-press, it is found that the hot-press temperature is preferably 160° C. or more and 185° C. or less, more preferably 170° C. or more and 180° C. or less.

(7) Experiment 7

Figure 18:
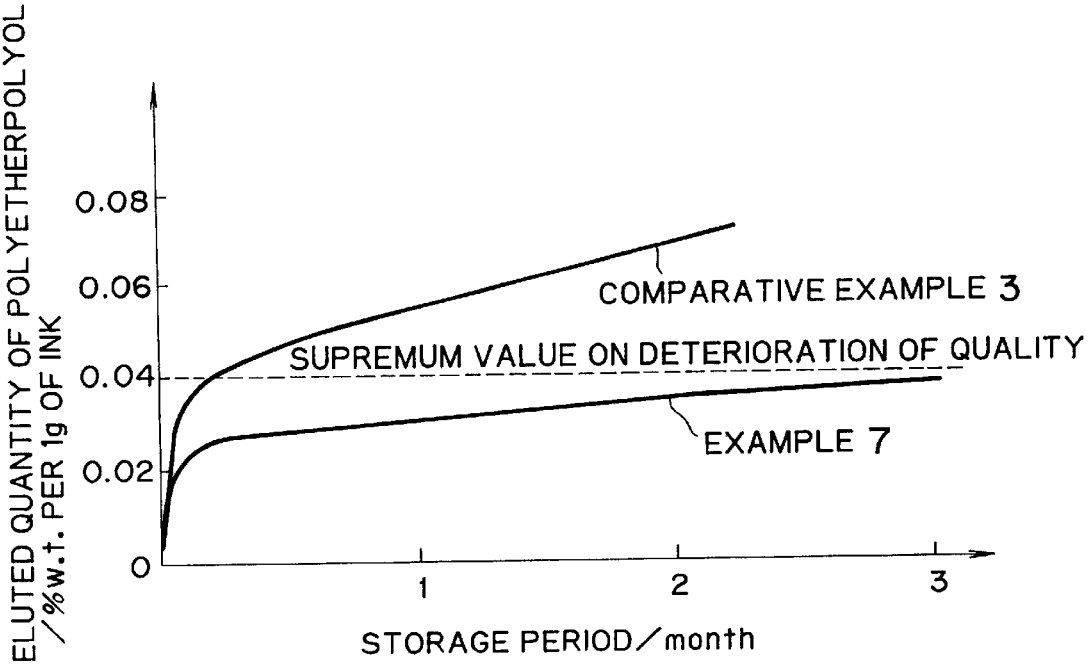
FIG. 18 is a characteristic figure representing the relation between the amount of polyether polyol extracted from the ink absorbers produced by hot-press and the storing time.

The ink absorber, produced by hot-pressing ether-type foaming polyurethane at a temperature of 180° C. for about 30 to 40 minutes while compressing the ether-type foaming polyurethane to one third, was charged in an ink tank. The polyurethane was then allowed to absorb ink, and was maintained at a temperature of 60° C. The relation between the storage period and the extract amount of polyether polyol was examined at this state. The method of measuring the extract amount was the same as in Experiment 4. The results are shown in the graph of FIG. 18. The storage at 60° C. for one month corresponds to the storage at ambient temperature for one year.

As is apparent from these results, the extract amount of polyether polyol increases gradually after a long-term storage. But the extract amount does not exceed the upper limit of the recording quality described above (0.04 wt % per g of ink), for a period of at least about 3 years which is the converted period at ambient temperature.

Comparative Example 3

The ink absorber, produced by hot-pressing ether-type foaming polyurethane at a temperature of 190° C. for about 30 to 40 minutes while compressing the ether-type foaming polyurethane to one-third, was measured in the same manner as in Experiment 7. The results are shown in FIG. 18. At an extremely earlier stage, the extract amount of polyether polyol into ink exceeded the upper limit of the deterioration of the recording quality.

Based on the comparison of the results of Experiment 7 with those of Comparative Example 3, it is found that in case that ether-type foaming polyurethane is used as ink absorbers provided that the hot press temperature is 180° C., namely within the temperature range of 150° C. or more and 180° C. or less, the extract amount of polyether polyol does not exceed the upper limit of the deterioration of the recording quality even after long-term storage, so that excellent recording quality is stably maintained. Alternatively, the hot press at a temperature beyond the temperature range of 150° C. or more and 180° C. or less (Comparative Example 3) causes the extract amount of polyether polyol above the upper limit of the deterioration of the recording quality during the process of long-term storage. The recording quality therefore cannot be maintained.

The explanation of the examples described above has been stated, regarding the ink-jet cartridge in which an ink tank and a recording head are integrated. The present invention is not limited to the examples, however. It is applied to an ink-jet recording system, in which an ink absorber comprising a porous layer is placed in an ink tank although the ink tank and a recording head are formed in separate structures.

As has been described above, the effect of the present invention can be brought about by simply employing any one of 1) the method of washing absorbers, 2) the method of selecting a heating temperature during a heating and compressing process of absorbers, and 3) the method of specifying the pH of the ink for impregnating the absorbers, as the method for reducing the extraction of impurities into ink. However, it is needless to say that the effect of the present invention can be realized by any appropriate combination thereof.

On further taking into account the actual mode of using the ink-jet cartridge placing the absorbers, for example, in case that an ink-jet cartridge is frequently used and ink is used up for a relatively short period, the method 1 or 2, or the combination of 1 and 2 is preferable; the combination of 1, 2 and 3 is more preferable. In case of using an ink-jet cartridge after long-term storage as another mode of its use, the method 3 hereinabove mentioned is preferable, but the combination of the methods 1 and 3, or the combination of the methods 2 and 3, is more preferable. Furthermore, the combination of the methods 1, 2 and 3 is the most preferable.

The material of elastic members of a cap was then examined. The present inventors carried out investigation, focussing foaming polyurethane to be used as an ink absorber.

Foaming polyurethane is generally produced by the polymerization of polyol and diisocyanate. Either polyester polyol or polyether polyol is commonly used as polyol; the product produced by employing the former is ester-type foaming polyurethane, while the product produced by employing the latter is ether-type foaming polyurethane.

The ink of an ink-jet recording device contains a large amount of water and alcohols as the solvents, and further contains urea ($CO(NH_2)_2$) in many cases. As has been described above, the ink-jet cartridge which is in the state of being filled with ink as a recording head and which integrally incorporates an ink tank, is packaged and stored one by one in an air-tight vessel for distribution. Water vapor and alcohol vapor are therefore filled in the vessel, and ammonia derived from urea is also present therein, so that the inside thereof is in alkaline atmosphere.

In case of ester foaming polyurethane, a great number of ester bonds other than urethane bonds (—NHCOO—) are present in the skeleton of polyurethane molecule. The ester bond other than these urethane bonds is easily hydrolyzed in alkaline atmosphere, and is deteriorated in a long period. Such tendency is distinct at high temperatures. The elastic member utilizing the ester foaming polyurethane is deteriorated by such reason. It is well known that the urethane bond is not readily hydrolyzed in alkaline atmosphere.

In case of ether-type foaming polyurethane, on the contrary, other ester bonds except urethane bonds are not included in the molecular skeleton thereof, so the hydrolysis of ester bonds does not occur, or such deterioration will not be induced.

Based on the above examination, the results of experiments which were carried out on various materials of elastic member 6 of cap 4, are explained.

(8) Experiment 8

According to a routine method, open cell-type foaming polyurethane was produced by using, as polyether polyol, propylene oxide adduct of glycerine, having a molecular weight of about 6000, and using toluene diisocyanate as diisocyanate. The resulting polyurethane was cut out in a preset size as elastic member 6, which was then anchored onto the body of cap 4. The cap 4 was mounted through seal sheet 3 onto ink-jet cartridge 11 filled with ink, and was enclosed and stored in an air-tight containing vessel 60 (FIGS. 7 and 8) for a long period while the temperature was maintained at 60° C. After a preset storage period ended, the ink-jet cartridge 11 with the cap 4 mounted was taken out from the air-tight containing vessel 60, to examine the degree of the deterioration of elastic member 6. The results are shown in Table 2.

Comparative Example 4

According to a routine method, open cell-type foaming polyurethane was produced by using caprolactone polyester polyol and toluene diisocyanate as polyester polyol and diisocyanate, respectively. The resulting polyurethane was cut out in a preset size and designated as an elastic member, which was then anchored onto the body of cap 4. The degree of the deterioration of elastic member 6 was then examined by the same method as in Example 1. The results are shown in Table 2.

As is apparent from the experimental results described above, in case that ether-type foaming polyurethane was used as the elastic member of the present invention, no deterioration was observed in the elastic member even after the storage in an air-tight containing vessel at a temperature of 60° C. for three months. Alternatively, in case that ester-type foaming polyurethane was used as the elastic member, its deterioration was observed under the storage in an air-tight containing vessel at 60° C. in as early as one month. Then after the storage for two months or more, the member was completely deteriorated, and the deteriorated part got to deposit onto an ink-jet cartridge. This is due to the reason that ether-type foaming polyurethane (Experiment 8) can endure the alkaline atmosphere caused by the ink vapor filled in the containing vessel, but ester-type foaming polyurethane (Comparative Example 4) lacks such endurance in the atmosphere because it is subjected to hydrolysis.

In the above Experiment 8, explanation was carried out provided that a cap was to be mounted onto an ink-jet cartridge as a recording head integrating an ink tank, but the present invention is not limited to the example. The present invention is applied even to the recording head being not integrated into an ink tank, in case that the recording head in the state of ink still remaining is taken out from the body of a recording system for separate storage.

Figure 19:
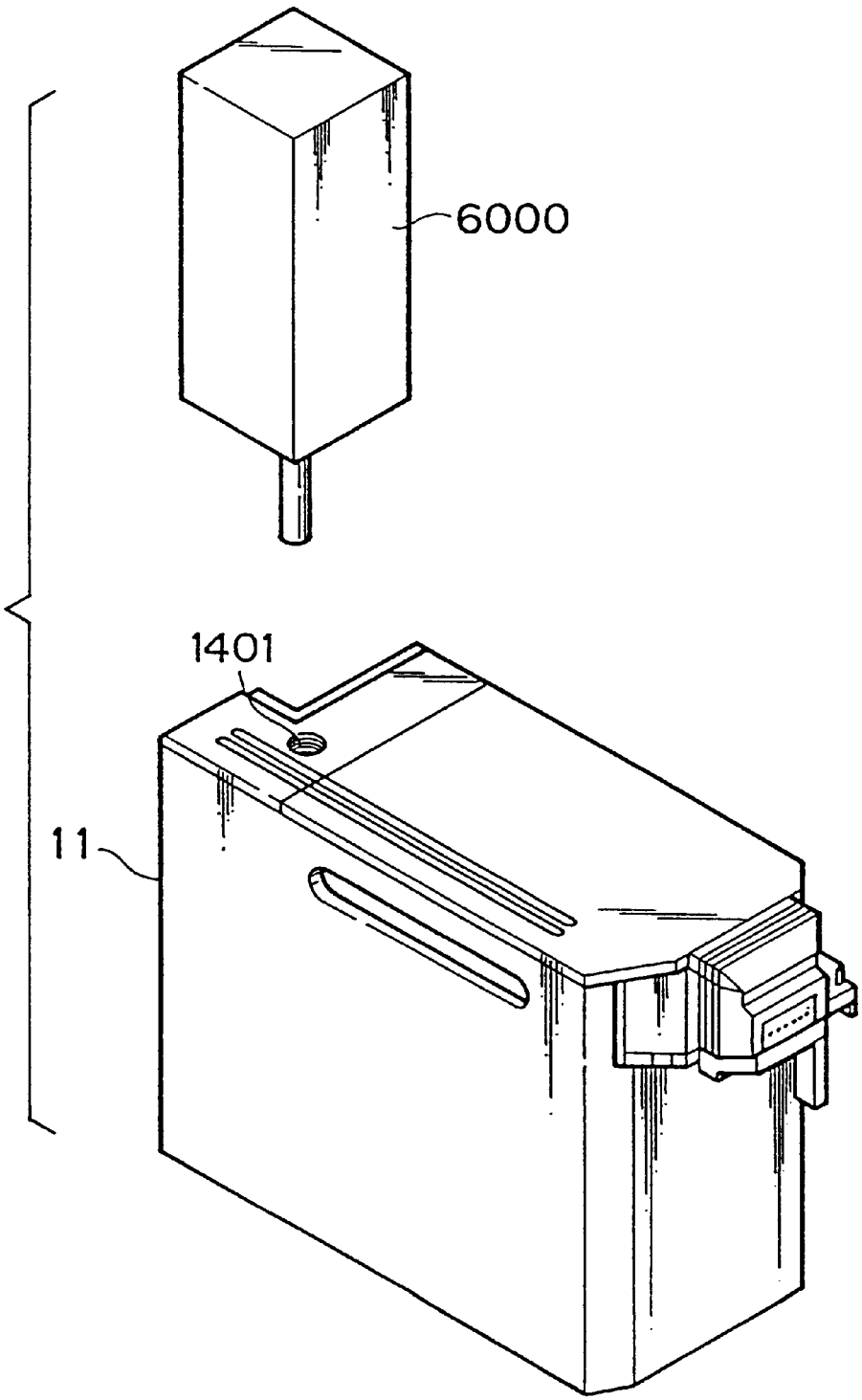
FIG. 19 shows an ink cartridge of which ink storing section is refilled with ink by using an ink filler.

Further, the ink cartridge 11 may be used as in the manner shown in FIG. 19 that the ink storing section is refilled with ink by using an ink filler 6000. For refilling, ink may be injected via the atmosphere-communicating opening 1401 of the ink cartridge, or otherwise it may be injected via the ink feeding opening on the head side or the hole provided on the ink cartridge.

Figure 20:
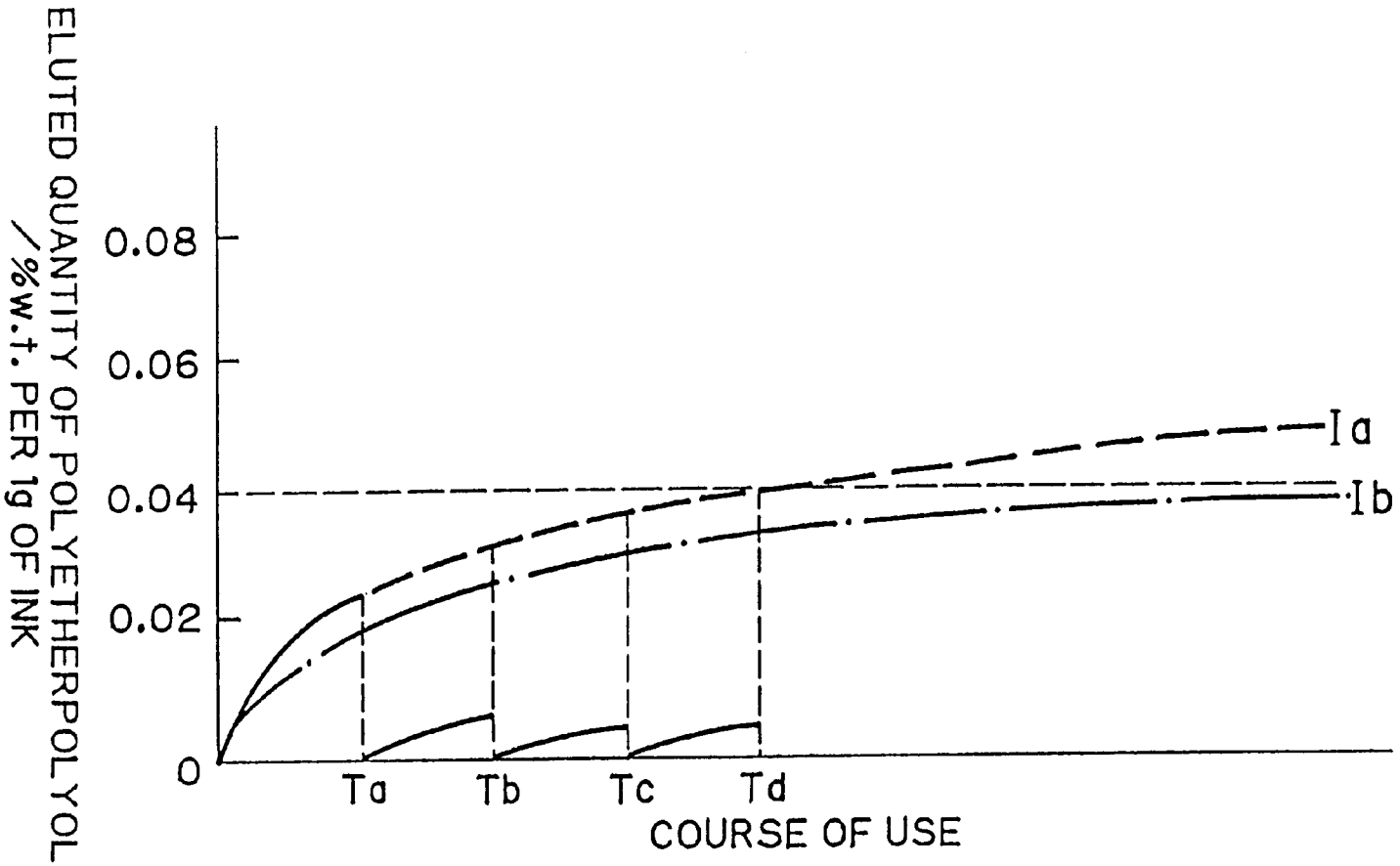
FIG. 20 shows a concentration change of polyether polyol in ink within an ink storing section with reference to the time lapse of use.

In this regard, one of the effects of the present invention that the recording quality is not deteriorated if the extracted (eluted) amount of polyether polyol into ink is 0.04% by weight or less per 1 gram of ink, is applied to establish a further invention in the use of an ink cartridge 11 as shown in FIG. 20.

FIG. 20 shows a concentration change of polyether polyol in ink within the ink storing section with reference to the time lapse in case of using it in such a manner.

Now, explanation is given as illustrating an ink in which the extracted amount of polyether polyol into the ink exceeds 0.04% as time passes as shown in I*a* of FIG. 20.

At the time point of T*a* of FIG. 20, since the ink using amount is large, ink is almost consumed before the aforementioned extracted amount exceeds 0.04% that is the upper limit of recording quality deterioration, and ink refilling is performed as shown in FIG. 19. Further, ink is again consumed at T*a* of FIG. 20 and next ink filling is performed. In a similar manner, consumed ink refilling is performed at T*c* and T*d*, respectively. In doing this, the extracted amount of polyether polyol does not exceed 0.04 wt % that is the upper limit of recording quality deterioration as aforementioned as shown by the solid line in FIG. 20. Accordingly, even such an ink exceeding the upper limit of recording quality deterioration as being used could accomplish recording with a high recording quality in case of employing a using method as described above.

Further needless to say, in case of using an ink in which the extracted amount of polyether polyol into the ink does not exceed 0.04 wt % that is the upper limit of recording quality deterioration as being used, as shown in I*b* of FIG. 20, the aforementioned use method never exceeds 0.04 wt % and therefore, recording with a high recording quality can always be effected.

Accordingly, both the absorbent member itself and the ink containing absorbent member of the present invention are particularly effective in a form being sold as a unit having an ink filler as shown in FIG. 19. Further, needless to say, the using method thereof and the recording method thereof constitute another invention included in the application which is preferable as the present invention.

The above working examples are further explained below as summarized.

There has been found a certain quantitative relation between the urethane-base absobent member used in the present invention and ink impregnated thereinto. This is explained below in detail.

In the following explanation, apparent volume of the absorbent member inserted in the ink storing section is represented as Vf, dry weight as Wf, and the weight of ink impregnated in the absorbent member is represented as Wi.

1) The ink jet cartridge or ink tank itself in the embodiments of the present invention is constituted as arranging the ink storing section directly connected to the ink jet head 12, i.e. so-called on cartridge type. One of the features of this type ink jet cartridge is that water head difference from the head 12 is small.

In this case, feeding and holding of ink is determined by the balance between the surface tension assigned to the meniscus at the tip portion of the nozzle and the negative pressure assigned to the ink absorbent member in the ink storing section.

Since the surface tension by meniscus is considered constant depending to the nozzle structure, a negative pressure corresponding thereto is applied to the ink absorbent member. The negative pressure of ink absorbent member varies depending on the ink amount impregnated therein, that is, it decreases as the ink amount increases and it increases as the ink amount decreases. Therefore, in order to accomplish smooth ink feeding and hold ink not to cause ink leaking by change of atmospheric condition, there exist an upper limit and an lower limit in the ink amount to be contained.

Based on this way of consideration, an exemplary limitative absorbent member shown in the above examples, i.e. an ink absorbent member pressed to one-third of the inherent volume and having a dry weight Wf, was used and Wi of ink was injected thereto to give a suitable negative pressure. In this case, Wi/Wf was approximately five.

Therefore, it is clear that if the amount of extractable matter in the ink absorbent member is 0.2 wt % or less per g of absorbent member, the extracted amount to ink does not exceed 0.04 wt %.

2) Even taking into acount the process of injecting ink into the above ink absorbent member, the above upper limit of extracted amount was found to be still kept good. That is, in case of injecting ink to the ink absorbent member having an weight Wf from the atmosphere-communication opening or other portion, it is necessary to once evacuate and fill up to the tip of the nozzle with ink to thereby form an ink feeding path, but in this operation, more than Wi, the amount to be eventually held, of ink was injected (i.e. more than 5 Wf of ink was contacted to the ink absorbent member), and the impurity extracted amount to ink was below 0.04 wt %.

3) On the other hand, in case of injecting ink via the ink feeding opening 1200 before attaching the ink jet unit 13, it is considered preferable to evacuate in the same manner and then inject a predetermined amount Wi' of ink. This is because that in this case, since ink feeding path is necessarily formed near the feeding tube, the step of flooding once is not needed. Accordingly, though Wi' is less than Wi, if the injection amount is below Wi, a portion not containing ink is formed and the weight of absorbent member actually containing ink, i.e. effective weight Wf', is below Wf.

Wf' was calculated as roughly described below.

A container having the same shape and size as the ink tank 14 shown in the working examples were made of a transparent plastic material and a certain amount Wi' of black ink was injected. After the progress of ink impregnation, the whole surface of the tank was observed and the immersion state of each face was measured. By combinating these measurements, the volume of immersed portion was calculated. From this value, together with the apparent volume Vf of the ink absorbent member and the dry weight of the same absorbent member Wf, Wf' was calculated according to the following equation:

$$Wf'=(Vi/Vf)Wf \quad (A)$$

Wf' values were calculated with changing Wi' little by little and the values. of Wi'/Wf' were approximately 5. Also in this case, the impurity extracted amount did not exceed 0.04 wt %.

Next, the ink absorbent member inserted in the ink storing section at a pressed ratio other than the aforementioned case of pressing the ink absorbent member to one-third of its inherent volume.

4) The apparent volume of the ink absorbent volume pressed to one-third of its inherent volume is represented by Vf, and its dry weight is represented by Wf. The ink absorbent member pressed to l/n was cut into an apparent volume Vf and its dry weight Wfp was found as follows:

$$Wfp=(n/3)Wf \quad (B)$$

At this time, ink was injected so as to give a suitable negative pressure and the injected amount Wip gave a suitable negative pressure.

In case of n<3, approximately $$Wip=(n/3)Wi \quad (C)$$

and in case of n>3

$$Wip=(n/3)Wi \quad (D)$$

were obtained.

The result of (D) can be interpreted to be that as the rate of compression rises, vacant pores become smaller significantly and the negative pressure of ink becomes very higher, thereby necessitating to inject a larger amount of ink into the ink absorbent member to obtain a suitable level of negative pressure as compared to the case of compression to one-third.

Thus, the relation $$Wip/Wfp \geqq Wi/Wf=5 \quad (E)$$

was obtained and consequently, the extracted amount of impurity into ink could be kept below 0.04 wt %.

5) Further, an experiment was performed in the same manner using the ink absorbent member having a different pore size, and it was found that the primary controlling factor was the same as the above (4).

The ink-absorbing body may be prepared from cellulose or a cellulose derivative.

Further, the ink-absorbing body may be prepared from foamed polyurethane produced by use of a propylene oxide adduct of sucrose as the polyetherpolyol for the polyol.

Further, the ink-absorbing body may be prepared from foamed polyurethane produced by use of an ethylene oxide-propylene oxide adduct of sucrose as the polyetherpolyol for the polyol.

Further, the ink-absorbing body may be prepared from foamed polyurethane produced by use of a propylene oxide adduct of an aromatic amine as the polyetherpolyol for the polyol.

Further, the ink-absorbing body may be prepared from foamed polyurethane produced by use of an ethylene oxide-propylene oxide adduct of an aromatic amine as the polyetherpolyol for the polyol.

Further, the ink-absorbing body may be prepared from foamed polyurethane produced by use of a propylene oxide adduct of an aliphatic amine as the polyetherpolyol for the polyol.

Further, the ink-absorbing body may be prepared from foamed polyurethane produced by use of an ethylene oxide-propylene oxide adduct of an aliphatic amine as the polyetherpolyol for the polyol.

Ink for use in the present invention may be either aqueous or non-aqueous. Aqueous ink is preferably used. An aqueous ink is basically composed of water, a water soluble organic solvent, an additive, and a coloring matter. The organic solvent includes polyhydric alcohols, glycol ethers, nitrogen-containing solvents, lactones, aliphatic monohydric alcohols, and the like. Among them, particularly preferably polyhydric alcohols are glycerin, diethylene glycol, ethylene glycol, polyethylene glycol, thiodiglycol, 1,2,6-hexanetriol, and the like. Particularly preferable glycol ethers are triethylene glycol monomethyl ether, and the like. Particularly preferable nitrogen-containing solvents are N-methyl-2-pyrrolidone, 2-pyrrolidone, 1,3-dimethyl-2-imidazolidinone. Particularly preferable lactones are γ-butyrolactone, and the like. Particularly preferable aliphatic monohydric alcohols are ethanol, isopropyl alcohol, and the like. Generally these solvents are combinedly used. As the additive, a surfactant, a pH controller, a mildew-proofing agent, and so forth are used. As the coloring matter, a water-soluble dye or pigment may be used, among which water-soluble dyes, especially acidic dyes, direct dyes, and basic dyes are preferable. In the preferable composition of these consltituents, water is contained at a content ranging from 70 to 95% by weight, more preferably from 75 to 90% by weight; the water-soluble organic solvent from 3 to 40% by weight, more preferably from 3 to 20% by weight, still more preferably from 5 to 15% by weight; the coloring matter from 0.5 to 10% by weight, more preferably from 1 to 6% by weight; and the additive from 0.01 to 1.0% by weight. As the preferable properties of ink, the viscosity is in the range of from 1 to 4 cp, more preferably 1 to 3 cp; the surface tension from 35 to 65 dyn/cm, and pH from 3 to 10.

The present invention is applicable to recording heads, and recording apparatuses of ink-jet recording systems, especially of ink-jet systems which employ thermal energy to form flying droplets and conduct recording therewith.

The ink-jet recording systems is constituted and utilized preferably based on the principle disclosed in U.S. Pat. No. 4,723,129 and U.S. Pat. No. 4,740,796. This system is useful both in on-demand types and in continuous types. Particularly it is useful in the on-demand types in which at least one driving signal for giving rapid temperature rise exceeding nuclear boiling temperature corresponding to recording information is applied to an electro-thermal transducer placed in proximity to a sheet or a liquid flow path where liquid (ink) is held, whereby thermal energy is generated in the electro-thermal transducer to cause film boiling on the heating face of a recording head, and consequently bubbles are formed in the liquid (ink) corresponding to the driving signal. The growth and constriction of the bubbles drives the ink to eject through ejection opening, and at least one droplet is formed. A pulse shape of driving signal is preferable since the growth and constriction of the bubbles is made instantaneously and suitably, and ink is ejected with high responsiveness.

Suitable pulse shape driving signals are such that are described in U.S. Pat. No. 4,463,359, and U.S. Pat. No. 4,345,262. Further better recording can be conducted by employing the conditions described in U.S Pat. No. 4,313,124 regarding the invention on the temperature rise rate on the heating face.

The present invention is applicable to the constitution of recording heads having heating portions placed at bending portions as disclosed in U.S. Pat. No. 4,558,333 and U.S. Pat. No. 4,459,600 in addition to the constitution composed of ejection openings, liquid flow paths, and electro-thermal transducer (linear liquid flow paths or rectangular liquid flow paths).

The present invention is also applicable to the constitution having a slit as an ejection portion common to a plurality of electro-thermal transducers as disclosed in Japanese Patent Application Laid-Open No. Sho-59-123670, and to the constitution having an opening for absorbing a pressure wave of thermal energy corresponding to an ejection portion as disclosed in Japanese Patent Application Laid-Open No. Sho-59-138461.

The present invention is also applicable to a full-line type recording head being constituted of a plurality of recording heads for covering the length as shown in the above patent specifications or being constituted of one recording unit formed integrally in one body, corresponding to the maximum breadth of recording mediums.

The present invention is also applicable to an exchangeable chip type recording head which can be electrically connected to the main apparatus body or can receive supply of ink from the main apparatus body when mounted on the main apparatus body, and to a cartridge type recording head having an ink tank integrally with the head.

The effect of the present invention is further ensured by adding a recovery means for the recording head, additional auxiliary means, or the like as constitutional parts of a recording apparatus of the present invention. Specific examples of the means for the recording head are a capping means, a cleaning means, a pressuring or sucking means, a preliminary heating means comprising an electro-thermal transducer or another heating element or combination thereof, and practice of preliminary ejection mode for non-recording ejection.

The present invention is effective not only in one color recording mode using black color or other one color but also recording by an apparatus employing an integrated recording head or a combination of recording heads, and using multiple different colors or full colors by color mixing.

The recording apparatuses of the present invention include image output terminals of information-treating apparatus such as word processors and computers provided integrally or separately, copying apparatuses combined with a reader, and facsimile apparatuses having functions of sending and receiving information.

In accordance with the present invention, as has been explained above, stable, clean absorbers with sufficient cleanness and a little variation can be obtained, by a non-polluting and simple method. The extract amount of the impurities contained in absorbers can be accurately measured, so absorbers with a constant cleanness can be routinely obtained.

Because the absorbers does not have any effect on ink even after a long-term storage, an excellent ink-jet recording head can be provided.

Because there are no or less organic matters extracted from ink absorbers, the deterioration of recording quality due to organic matters is prevented and the stable recording quality can be maintained for a long period as well.

In accordance with the present invention, the amount of organic matters as impurities extracted from ink absorbers, decreases by forming the ink absorbers comprising polymeric elastic porous body having inside open cells, at a temperature less than the critical temperature at thermal compression of the porous body. Therefore, there can be obtained such effect that a step of washing is not required, which simplifies the production process with no use of harzardous solvents and which can maintain the stable recording quality for a long period.

Specifically in case that ether-type foaming polyurethane is used as an ink absorber, the amount of polyether polyol to be extracted into ink can be reduced to not more than the level causing the deterioration of recording quality, by setting the hot-press temperature at 150° C. or more and 185° C. or less, whereby there are brought about the effects of stabilizing the recording quality for a long term and of preventing a period for hot-press from extreme prolongation.

In accordance with the present invention, furthermore, because ether foaming polyurethane is used as the elastic member of a cap, the elastic member will not deteriorate even after a long-term storage of an ink-jet cartridge in an air-tight containing vessel and at its distribution, and the leakage of ink can be prevented; even if ink leakage should occur, this is absorbed into the elastic member, so the enlargement of ink contamination can be prevented.

TABLE 2

| Storage Period | 1 month at 60° C. | 2 month at 60° C. | 3 month at 60° C. |
|---|---|---|---|
| Example 8 | no deterioration | no deterioration | no deterioration |
| Comparative Example 4 | impregnation of water slightly softened | deteriorated, and deposited on inkjet cartridge 11 | deteriorated, and deposited on inkjet cartridge 11 |

We claim:

1. An ink tank, which comprises (a) an ink for recording, (b) an ink storing section, and (c) an ink absorbent member for impregnating said ink stored in said ink storing section, said ink absorbent member comprising a polyurethane that has been heat-pressed to a predetermined compression ratio, which is prepared by using polyetherpolyol as a starting material, wherein the weight of polyetherpolyol eluted from said member into said ink is equal to or less than 0.04% by weight based on the weight of the ink.

2. An ink tank according to claim 1, wherein the polyetherpolyol is a compound having an infrared absorption spectrum with a peak at least at 1110 $cm^{-1}$.

3. An ink tank according to claim 1, wherein the ink contains at least water, a water-soluble organic solvent and a coloring agent.

4. An ink tank according to claim 3, wherein the coloring agent is at least one of water soluble dyes and pigments.

5. An ink tank according to claim 3, wherein the coloring agent is at least one member selected from the group consisting of acid dyes, direct dyes and basic dyes.

6. An ink tank according to claim 1, wherein the ink has a pH of 8 to 10.

TABLE 1

| | Content of eluted matters*1 (wt %) | | | Printing test (stored at 60° C.) | | | | | | | | | | | |
|---|---|---|---|---|---|---|---|---|---|---|---|---|---|---|---|
| | | After | After | Initial | | | 1 month later | | | 2 month later | | | 3 month later | | |
| No. | Initial | washing once | washing twice | O.D. | Bleeding | Strike-through | O.D. | Bleeding | Strike-through | O.D. | Bleeding | Strike-through | O.D. | Bleeding | Strike-through |
| Example 1 | 0.25 | 0.07 | — | ○ | ○ | ○ | ○ | ○ | ○ | ○ | ○ | ○ | ○ | ○ | ○ |
| Example 2 | 0.25 | 0.1 | — | ○ | ○ | ○ | ○ | ○ | ○ | ○ | ○ | ○ | ○ | ○ | ○ |
| Example 3 | 0.25 | 0.09 | — | ○ | ○ | ○ | ○ | ○ | ○ | ○ | ○ | ○ | ○ | ○ | ○ |
| Example 4 | 0.65 | 0.15 | — | ○ | ○ | ○ | ○ | ○ | ○ | ○ | ○ | ○ | ○ | ○ | ○ |
| Example 5 | 0.25 | 0.12 | — | ○ | ○ | ○ | ○ | ○ | ○ | ○ | ○ | ○ | ○ | ○ | ○ |
| Example 6 | 0.65 | — | 0.03 | ○ | ○ | ○ | ○ | ○ | ○ | ○ | ○ | ○ | ○ | ○ | ○ |
| Example 7 | 0.65 | 0.19 | — | ○ | ○ | ○ | ○ | ○ | ○ | ○ | ○ | ○ | ○ | Δ | ○ |
| Example 8 | 0.65 | 0.20 | | ◎ | ◎ | ◎ | ◎ | ◎ | ◎ | ○ | ○ | ○ | ○ | Δ | ○ |
| Compapative Example 1 | 0.25 | — | — | ○ | ○ | ○ | ○ | Δ | ○ | Δ | Δ | Δ | x | x | x |
| Comparative Example 2 | 0.65 | — | — | Δ | Δ | Δ | Δ | x | Δ | x | x | x | x | x | x |
| | PEPO Content in ink (wt % absorber) | | | | | | | | | | | | | | |
| Reference Example NO. 1 | 0.10 | — | | ○ | ○ | ○ | | | | | | | | | |
| Reference Example NO. 2 | 0.15 | — | | ○ | ○ | ○ | | | | | | | | | |
| Reference Example NO. 3 | 0.2 | — | | ○ | ○ | ○ | | | | | | | | | |
| Reference Example NO. 4 | 0.25 | — | | x | x | x | | | | | | | | | |
| Reference Example NO. 5 | 0.0 | — | | ○ | ○ | ○ | | | | | | | | | |

*1: Content of eluted matters represents wt % to 1 g of an ink absorber

7. An ink tank according to claim 1, wherein the heat-pressing is conducted at 150 to 185° C. of 3 through 10.

8. An ink tank according to claim 1, wherein the ink has a pH value in a range of 3 through 10.

9. An ink tank according to claim 1, wherein if the heat-pressing temperature is higher than 185° C., polyetherpolyol is extracted with an organic polar solvent.

10. An ink jet cartridge, which comprises (a) an ink tank having an ink for recording, (b) an ink storing section, (c) an ink absorbent member for impregnating the ink stored in said ink storing section, and (d) an ejection energy generating means for ejecting the ink, the ink absorbent member comprising a polyurethane that has been heat-pressed to a predetermined compression ratio, which is prepared by using polyetherpolyol as a starting material, wherein the weight of polyetherpolyol eluted from said member into the ink is equal to or less than 0.04% by weight based on the weight of the ink.

11. An ink jet cartridge according to claim 10, wherein the polyetherpolyol is a compound having an infrared absorption spectrum with a peak at least at 1110 $cm^{-1}$.

12. An ink jet cartridge according to claim 10, wherein the ink contains at least water, a water-soluble organic solvent and a coloring agent.

13. An ink jet cartridge according to claim 12, wherein the coloring agent is at least one of water-soluble dyes and pigments.

14. An ink jet cartridge according to claim 12, wherein the coloring agent is at least one member selected from the group consisting of acid dyes, direct dyes and basic dyes.

15. An ink jet cartridge according to claim 10, wherein the ink has a pH of 8 to 10.

16. An ink jet cartridge according to claim 10, wherein the injection energy generating means is a means for generating heat energy for causing film boiling in the ink by supply of electric signals according to recording signals.

17. An ink jet cartridge according to claim 10, wherein the heat-pressing is is conducted at 150 to 185° C.

18. An ink jet cartridge according to claim 10, wherein the ink has a pH value in a range of 3 through 10.

19. An ink jet cartridge according to claim 10, wherein if the heat-pressing temperature is higher than 185° C., polyetherpolyol is extracted with an organic polar solvent.

20. An ink jet cartridge, which comprises (a) an ink storing section comprising (i) an atmosphere-communicating opening, (ii) an ink discharge port at a position different from a position of said atmosphere-communicating opening, and (iii) an ink absorbent member, (b) an ejection energy generating means for ejecting the ink, (c) an ink chamber for storing the ink for supplying the ink to the ejection energy generating means, (d) a supply pipe for leading the ink to said ink absorbent member in said ink storing section under pressure, and (e) a filter provided at the end of said supply pipe, said ink absorbent member comprising a polyurethane that has been heat-pressed to a predetermined compression ratio, which is prepared by using polyetherpolyol as a starting material, wherein the weight of polyetherpolyol eluted from said member into the ink is equal to or less than 0.04% by weight based on the weight of the ink.

21. An ink jet cartridge according to claim 20, wherein the polyetherpolyol is a compound having an infrared absorption spectrum with a peak at least at 1110 $cm^{-1}$.

22. An ink jet cartridge according to claim 20, wherein the ink contains at least water, a water-soluble organic solvent and a coloring agent.

23. An ink jet cartridge according to claim 22, wherein the coloring agent is at least one of water-soluble dyes and pigments.

24. An ink jet cartridge according to claim 22, wherein the the coloring agent is at least one member selected from the group consisting of acid dyes, direct dyes and basic dyes.

25. An ink jet cartridge according to claim 20, wherein the ink has a pH of 8 to 10.

26. An ink jet cartridge according to claim 20, wherein the ejection energy generating means is a means for generating heat energy for causing film boiling in the ink by supply of electric signals according to recording signals.

27. An ink jet cartridge according to claim 20, wherein the heat-pressing is conducted at 150 to 185° C.

28. An ink jet cartridge according to claim 20, wherein the ink has a pH value in a range of 3 through 10.

29. An ink jet cartridge according to claim 20, wherein if the heat-pressing temperature is higher than 185° C., polyetherpolyol is extracted with an organic polar solvent.

30. An ink jet recorking apparatus, which comprises (a) an ink jet cartridge comprising (i) an ink tank with an ink for recording, (ii) an ink storing section, and (iii) an ink absorbent member for impregnating the ink stored in said ink storing in said ink storing section, and (b) an ejection energy generating means for ejecting the ink, and (c) a carriage capable of moving said ink jet cartridge in a desired direction, said ink absorbent member comprising a polyurethane that has been heat-pressed to a predetermined compression ratio, which is prepared by using polyetherpolyol as a starting material, wherein the weight of ployetherpolyol eluted from said member into the ink is equal to or less than 0.04% by weight based on the weight of the ink.

31. An ink jet recording apparatus according to claim 30, wherein the soluble matters are compounds having an infrared absorption spectrum with a peak at least at 1110 $cm^{-1}$.

32. An ink jet recording apparatus according to claim 30, wherein the ink contains at least water, a water-soluble organic solvent and a coloring agent.

33. An ink jet recording apparatus according to claim 32, wherein the coloring agent is at least one of water-soluble dyes and pigments.

34. An ink jet recording apparatus according to claim 32, wherein the coloring agent is at least one member selected from the group consisting of acid dyes, direct dyes and basic dyes.

35. An ink jet recording apparatus according to claim 30, wherein the ink has a pH of 8 to 10.

36. An ink jet recording apparatus according to claims 30, wherein the ejection energy generating means is a means for generating heat energy for causing film boiling in the ink by supply of electric signals according to recording signals.

37. An ink jet recording apparatus according to claim 30, wherein the heat-pressing is is conducted at 150 to 185° C.

38. An ink jet cartridge according to claim 30 wherein the ink has a pH value in a range of 3 through 10.

39. An ink jet recording apparatus according to claim 30, wherein if the heat-pressing temperature is higher than 185° C., polyetherpolyol is extracted with an organic polar solvent.

40. An ink tank, which comprises (a) an ink for recording, (b) an ink storing section, and (c) an ink absorbent member encased in said ink storing section impregnated with ink, said ink comprising urea, and said ink absorbent member comprising a polyurethane that has been heat-pressed to a predetermined compression ratio, which is prepared by using polyetherpolyol as a starting material, wherein the weight of polyetherpolyol eluted from said member into the ink is equal to or less than 0.04% by weight based on the weight of the ink.

41. An ink tank according to claim 40, wherein the polyetherpolyol is a compound having an infrared absorption spectrum with a peak.at least at 1110 $cm^{-1}$.

42. An ink tank according to claim 40, wherein the ink contains at least water, a water-soluble organic solvent and a coloring agent.

43. An ink tank according to claim 42, wherein the coloring agent is at least one of water-soluble dyes and pigments.

44. An ink tank according to claim 42, wherein the coloring agent is at least one member selected from the group consisting of acid dyes, direct dyes and basic dyes.

45. An ink tank according to claim 40, wherein the ink has a pH of 8 to 10.

46. An ink tank according to claim 40, wherein the heat-pressing is conducted at 150 to 185° C.

47. An ink tank according to claim 40, wherein the ink has a pH value in a range of 3 through 10.

48. An ink tank according to claim 40, wherein if the heat-pressing temperature is higher than 185° C., polyetherpolyol is extracted with an organic polar solvent.

49. An ink jet cartridge, which comprises (a) an ink tank having an ink for recording, (b) an ink storing section, (c) an ink absorbent member impregnated with said ink stored in said ink storing section, and (d) an ejection energy generating means for ejecting said ink, said ink comprising urea and said ink absorbent member comprising a polyurethane that has been heat-pressed to a predetermined compression ratio, which is prepared by using polyetherpolyol as a starting material, wherein the weight of polyetherpolyol eluted from said member into the ink is equal to or less than 0.04% by weight based on the weight of the ink.

50. An ink jet cartridge according to claim 49, wherein the polyetherpolyol is a compound having an infrared absorption spectrum with a peak at least at 1110 $cm^{-1}$.

51. An ink jet cartridge according to claim 49, wherein the ink contains at least water, a water-soluble organic solvent and a coloring agent.

52. An ink jet cartridge according to claim 51, wherein the coloring agent is at least one of water-soluble dyes and pigments.

53. An ink jet cartridge according to claim 51, wherein the coloring agent is at least one member selected from the group consisting of acid dyes, direct dyes and basic dyes.

54. An ink jet cartridge according to claim 49, wherein the ink has a pH of 8 to 10.

55. An ink jet cartridge according to claim 49, wherein the heat-pressing is conducted at 150 to 185° C.

56. An ink jet cartridge according to claim 49, wherein the ink has a pH value in a range of 3 through 10.

57. An ink jet cartridge according to claim 49, wherein if the heat-pressing temperature is higher than 185° C., polyetherpolyol is extracted with an organic polar solvent.

58. An ink jet recording apparatus, which comprises (a) an ink jet cartridge comprising (i) an ink tank with an ink for recording, (ii) an ink storing section, (iii) an ink absorbent member for impregnating the ink, and (iv) an ejection energy generating means for ejecting the ink, and (b) a carriage capable of moving said ink jet cartridge in a desired direction, the ink comprising urea, and said ink absorbent member comprising a polyurethane that has been heat-pressed to a predetermined compression ratio, which is prepared by using polyetherpolyol as a starting material, wherein the weight of polyetherpolyol eluted from said member into the ink is equal to or less than 0.04% by weight based on the weight of the ink.

59. An ink jet recording apparatus according to claim 58, wherein the polyetherpolyol is a compound having an infrared absorption spectrum with a peak at least at 1110 $cm^{-1}$.

60. An ink jet recording apparatus according to claim 58, wherein the ink contains at least water, a water-soluble organic solvent and a coloring agent.

61. An ink jet recording apparatus according to claim 60, wherein the coloring agent is at least one of water-soluble dyes and pigments.

62. An ink jet recording apparatus according to claim 60, wherein the coloring agent is at least one member selected from the group consisting of acid dyes, direct dyes and basic dyes.

63. An ink jet recording apparatus according to claim 58, wherein the ink has a pH of 8 to 10.

64. An ink jet recordin apparatus according to claim 58, wherein the heat-pressing is conducted at 150 to 185° C.

65. An ink jet recording apparatus according to claim 58, wherein the ink has a pH value in a range of 3 through 10.

66. An ink jet recording apparatus according to claims 58, wherein if the heat-pressing temperature is higher than 185° C., polyetherpolyol is extracted with an organic polar solvent.

67. A method for washing an ink absorbent member to be encased in an ink storing tank in an ink jet cartridge, the ink absorbent member being made from polyurethane which is prepared by using polyetherpolyol as a starting material, the washing being carried out after heat-pressing of the ink absorbent member, the method comprising washing with a washing agent containing an organic polar solvent incapable of reacting with the ink absorbent member until polyetherpolyol contained in the ink absorbent member is reduced to a content of not more than 0.20% by weight on the basis of the ink absorbent member.

68. A method according to claim 67, wherein the organic polar solvent is at least one member selected from the group consisting of monohydric alcohols having not more than three carbon atoms and alkyl ethers of polyhydric alcohols.

69. A method according to claim 67, wherein the washing agent is ethanol.

70. A method according to claim 67, wherein the polyetherpolyol is a compound having an infrared absorption spectrum with a peak at least at 1110 $cm^{-1}$.

71. A method according to claim 69, wherein the heat-pressing is conducted at 150° C. or more.

72. A method for manufacturing an ink tank comprising an ink absorbent member and a container encasing the ink absorbent member, the method comprising the steps of:

washing the ink absorbent member being made from polyurethane which is prepared by using polyetherpolyol as a starting material, after heat-pressing, with a washing agent containing an organic polar solvent incapable of reacting with the ink absorbent member until polyetherpolyol contained in the ink absorbent member is reduced to a content of not more than 0.20% by weight on the basis of the ink absorbent member; and inserting the ink absorbent member into the container.

73. A method according to claim 72, wherein the heat-pressing is conducted at 150° C. or more.

74. A method for manufacturing an ink jet cartridge comprising an ink tank including an ink absorbent member and a container encasing the ink absorbent member, and an ink-jet unit including an ink-jet head, the method comprising the steps of:

washing the ink absorbent member being made from polyurethane which is prepared by using polyetherpolyol as a starting material, after heat-pressing, with a washing agent containing an organic polar solvent incapable of reacting with the ink absorbent member until polyetherpolyol contained in the ink absorbent member is reduced to a content of not more than 0.20% by weight on the basis of the ink absorbent member; and inserting the ink absorbent member into the container.

75. A method according to claim 74, wherein the heat-pressing is conducted at 150° C. or more.

* * * * *

UNITED STATES PATENT AND TRADEMARK OFFICE

CERTIFICATE OF CORRECTION

PATENT NO. : 5,936,649
DATED : August 10, 1999
INVENTOR(S) : Masami Ikeda et al.

It is certified that error appears in the above-identified patent and that said Letters Patent is hereby corrected as shown below:

Title page,
Item [45], Date of Patent "*Aug. 10, 1999" should read -- Aug. 10, 1999 --.
" [*] Notice: This patent issued on a continued prosecution application filed under 37 CFR 1.53 (d), and is subject to the twenty year patent term provisions of 35 U.S.C. 154 (a) (2)." should be deleted.
Item [56], OTHER PUBLICATIONS, insert -- Patent Abstracts of Japan, Vol. 13, No. 204 (M-285) (3552), May 15, 1989. --.

Item [57], ABSTRACT,
Line 3, "then" should read -- than --.

Column 1,
Line 28, "(=corresponding" should read -- (corresponding --.
Line 35, "for-removing" should read -- for removing --.
Line 51, "the" should be deleted.
Line 67, "an ink" should read -- ink --.

Column 2,
Line 2, "entire" should be deleted.
Line 11, "the" should be deleted.
Line 29, "Moreover" should read -- Moreover, --.
Line 30, "ink" should read -- the ink --.
Line 48, "lowered" should read -- lowered, -- and "to" should be deleted.
Line 49, "cause an" should be deleted.

Column 3,
Line 18, "a primary" should read -- primary --.

Column 4,
Line 3, "exampleo" should read -- example --.
Line 4, "he" should read -- of the --.
Line 5, "of e" should read -- of the --.
Line 10, "14for" should read -- 14 for --.
Line 12, "recordit" should read -- recording --.
Line 41, "which ink" should read -- which an ink --.

Column 5,
Line 2, "apparatus ," should read -- apparatus, --.
Line 13, "serve" should read -- serves --.
Line 39, "is supplied" should read -- are supplied --.
Line 41, "a plane" should read -- , a plane, --.

UNITED STATES PATENT AND TRADEMARK OFFICE

CERTIFICATE OF CORRECTION

PATENT NO. : 5,936,649
DATED : August 10, 1999
INVENTOR(S) : Masami Ikeda et al.

It is certified that error appears in the above-identified patent and that said Letters Patent is hereby corrected as shown below:

Column 6,
Line 5, "11,as" should read -- 11, as --.
Line 7, "a parallel" should read -- parallel --.
Line 62, "2300" should read -- 2300, --.
Line 63, "number" should read -- number, --.

Column 7,
Line 5, "all" should read -- entire --.
Line 27, "substantially of the entire ink" should be deleted.
Line 35, "early" should be deleted.
Line 36, "state." should read -- state early. --.
Line 38, "example" should read -- example, --.
Line 50, "Such" should be deleted and "movel" should read -- novel --.
Line 52, "far" should be deleted.
Line 67, "register" should read -- registers with --.

Column 8,
Line 1, "L" should read -- $L_1$ --.
Line 5, "the a" should read -- the --.
Line 17, "approximate" should read -- the approximate --.
Line 22, "$L_2$," should read -- $L_2$ --.
Line 61, "jointing" should read -- joining --.

Column 9,
Line 32, "face" should read -- faces --.
Line 51, "each pads" should read -- each of pads --.
Line 17, "projection" should read -- projected --.
Line 37, "constitutes" should read -- constitute --.

Column 11,
Line 21, "deep" should read -- deeply --.
Line 24, "that is" should read -- that is, --.
Line 27, "to a" should read -- at the --.
Line 65, "thickness-of" should read -- thickness of --.

Column 12,
Line 26, "an unstableness" should read -- instability --.

UNITED STATES PATENT AND TRADEMARK OFFICE

CERTIFICATE OF CORRECTION

PATENT NO. : 5,936,649
DATED : August 10, 1999
INVENTOR(S) : Masami Ikeda et al.

It is certified that error appears in the above-identified patent and that said Letters Patent is hereby corrected as shown below:

Column 13,
Line 8, "an" should read -- or an --.
Line 42, "poly-propylene" should read -- polypropylene --.
Line 58, "of." should read -- of --.

Column 14,
Line 22, "polyethertype" should read -- polyether-type --.
Line 43, "sizes." should read -- size. --.
Line 47, "nitrogen-" should read -- and nitrogen- --.

Column 15,
Line 48, "is" should read -- are --.

Column 16,
Line 21, "slows" should read -- shows --.

Column 17,
Line 32, "member-is" should read -- member is --.
Line 43, "ten" should read -- tens of --.
Line 45, "ten" should read -- tens of --.

Column 20,
Line 46, "Comparative" should be deleted.
Line 47, "Example 2." should read -- Comparative Example 2 -- (centered as a title).
Line 49, "was" should read -- were --.

Column 27,
Line 9, "absobent" should read -- absorbent --.
Line 49, "acount" should read -- account --.
Line 52, "an" should read -- a --.

Column 28,
Line 10, "combinating" should read -- combining --.
Line 19, "values." should read -- values --.
Line 22, "inserted" should read -- was inserted --.

Column 29,
Line 39, "conslituents" should read -- constituents --.
Line 53, "systems" should read -- system --.

UNITED STATES PATENT AND TRADEMARK OFFICE

CERTIFICATE OF CORRECTION

PATENT NO. : 5,936,649
DATED : August 10, 1999
INVENTOR(S) : Masami Ikeda et al.

It is certified that error appears in the above-identified patent and that said Letters Patent is hereby corrected as shown below:

Column 30,
Line 57, "apparatus" should read -- apparatuses --.

Column 31,
Line 1, "does" should read -- do --.

Column 33,
Line 2, "of 3 through 10" should be deleted.
Line 32, "injection" should read -- ejection --.

Column 34,
Line 1, "the" should be deleted.
Line 16, "recorking" should read -- recording --.
Line 20, "in said ink storing" should be deleted.
Line 26, "ployetherpolyol" should read -- polyetherpolyol --.
Line 30, "soluble matters are compounds" should read -- polyetherpolyol is a compound --.
Line 43, "claims" should read -- claim --.

Column 34,
Line 49, "cartridge" should read -- recording apparatus --.
Line 67, "peak.at" should read -- peak at --.

UNITED STATES PATENT AND TRADEMARK OFFICE

CERTIFICATE OF CORRECTION

PATENT NO. : 5,936,649
DATED : August 10, 1999
INVENTOR(S) : Masami Ikeda et al.

It is certified that error appears in the above-identified patent and that said Letters Patent is hereby corrected as shown below:

Column 36,
Line 7, "recordin" should read -- recording --.
Line 11, "claims" should read -- claim --.
Line 33, "69," should read -- 67, --.

Signed and Sealed this

Twentieth Day of November, 2001

*Attest:*

Nicholas P. Godici

*Attesting Officer*

NICHOLAS P. GODICI
*Acting Director of the United States Patent and Trademark Office*